US008285173B2

(12) United States Patent
Hashimoto

(10) Patent No.: US 8,285,173 B2
(45) Date of Patent: Oct. 9, 2012

(54) PROCESS CARTRIDGE WITH ENGAGING, URGING, AND ABUTTING PORTIONS FOR ENGAGEMENT OF THE PROCESS CARTRIDGE TO AN ELECTROPHOTOGRAPHIC IMAGE FORMING APPARATUS

(75) Inventor: Koji Hashimoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/174,009

(22) Filed: Jun. 30, 2011

(65) Prior Publication Data

US 2011/0268473 A1 Nov. 3, 2011

Related U.S. Application Data

(62) Division of application No. 11/953,231, filed on Dec. 10, 2007, now Pat. No. 8,086,135.

(30) Foreign Application Priority Data

Dec. 11, 2006 (JP) ..... 2006-332790
Nov. 16, 2007 (JP) ..... 2007-297474

(51) Int. Cl.
*G03G 21/16* (2006.01)

(52) U.S. Cl. ..... 399/111

(58) Field of Classification Search ..... 399/110, 399/111, 117, 119, 126
See application file for complete search history.

(56) References Cited

U.S. PATENT DOCUMENTS 5,740,500 A 4/1998 Hashimoto
5,923,924 A 7/1999 Hashimoto
6,016,408 A 1/2000 Hashimoto et al.
6,044,235 A 3/2000 Hashimoto
6,101,352 A 8/2000 Hashimoto et al.
6,151,459 A 11/2000 Hashimoto et al.
6,246,853 B1 6/2001 Suzuki et al.
6,285,847 B1 9/2001 Tanizaki et al.
(Continued)

FOREIGN PATENT DOCUMENTS

EP 0 586 044 9/1994
(Continued)

OTHER PUBLICATIONS

Australian Office Action dated Jul. 1, 2010, in corresponding Australian Application No. 2007332418.
(Continued)

*Primary Examiner* — Walter L Lindsay, Jr.
*Assistant Examiner* — Billy J Lactaoen
(74) *Attorney, Agent, or Firm* — Fitzpatrick, Cella, Harper & Scinto

(57) ABSTRACT

A process cartridge is detachably mountable to a main assembly of an electrophotographic image forming apparatus. The cartridge includes a photosensitive drum, and a developing roller for developing a latent image. A development coupling portion is provided adjacent to one axial end of the developing roller, with the development coupling portion including an engaging portion configured and positioned (a) to receive a driving force for rotating the developing roller, and (b) to be movable in a direction crossing the axis of the developing roller relative to the developing roller. The cartridge also includes an urging portion configured and positioned to urge the engaging portion in a direction crossing the axis of the developing roller. Also, an abutting portion is configured and positioned so that movement of the engaging portion can be prevented when the engagement portion has not established engagement with a development coupling member of the main assembly.

31 Claims, 26 Drawing Sheets

U.S. PATENT DOCUMENTS

| | | | | |
|---|---|---|---|---|
| 6,324,357 | B1 | 11/2001 | Gomi et al. | |
| 6,463,234 | B2 | 10/2002 | Arimitsu et al. | |
| 6,496,667 | B2 | 12/2002 | Shiratori et al. | |
| 6,505,021 | B2 | 1/2003 | Shibuya et al. | |
| 6,560,422 | B2 | 5/2003 | Kanno et al. | |
| 6,735,403 | B2 | 5/2004 | Kanno et al. | |
| 6,834,171 | B2 | 12/2004 | Nittani et al. | |
| 6,907,212 | B2 | 6/2005 | Harada et al. | |
| 7,027,754 | B2 | 4/2006 | Harada et al. | |
| 7,058,337 | B2 | 6/2006 | Hashimoto et al. | |
| 7,088,938 | B2 | 8/2006 | Hashimoto et al. | |
| 7,184,686 | B2 | 2/2007 | Kanno et al. | |
| 7,231,164 | B2 | 6/2007 | Harada et al. | |
| 7,233,752 | B2 | 6/2007 | Harada et al. | |
| 7,899,364 | B2 * | 3/2011 | Chadani et al. | 399/167 |
| 2005/0069342 | A1 | 3/2005 | Kanno et al. | |
| 2005/0152716 | A1 | 7/2005 | Agata et al. | |
| 2006/0029435 | A1 | 2/2006 | Kasai et al. | |
| 2006/0034637 | A1 | 2/2006 | Kim et al. | |
| 2006/0245785 | A1 | 11/2006 | Kawamura et al. | |
| 2007/0048016 | A1 | 3/2007 | Moon | |
| 2007/0071495 | A1 | 3/2007 | Hashimoto et al. | |
| 2007/0092291 | A1 | 4/2007 | Suzuki et al. | |
| 2008/0138114 | A1 | 6/2008 | Chadani et al. | |
| 2008/0138115 | A1 | 6/2008 | Chadani et al. | |

FOREIGN PATENT DOCUMENTS

| | | |
|---|---|---|
| EP | 1 258 783 | 11/2002 |
| EP | 1 596 258 | 11/2005 |
| JP | 2-021049 | 1/1990 |
| JP | 2000-214654 | 8/2000 |
| JP | 2001-255806 | 9/2001 |
| JP | 2005-292593 | 10/2005 |
| KR | 10-2006-0015154 | 2/2006 |
| KR | 10-0631219 | 9/2006 |

OTHER PUBLICATIONS

Office Action in Korean Patent Application No. 10-2009-7014393, dated Dec. 3, 2010.

International Search Report and Written Opinion of the International Searching Authority, dated Jun. 27, 2008, in International Application No. PCT/JP2007/074190.

Office Action in Japanese Patent Application No. 2009-28686, issued Apr. 5, 2011, with English translation.

English translation of Japanese Patent Laid-open No. 2-021049, JP 02-021049 published on Jan. 24, 1990.

Decision on Grant in Russian Patent Application No. 2009126551(036964), with English translation, Decision on Grant published on Jun. 7, 2011.

Notice of Allowance in Korean Patent Application No. 10-2009-7014393, issued Aug. 3, 2011.

Official Communication in Canadian Patent Application No. 2,669,851,dated Jan. 16, 2012.

Office Action in Taiwanese Patent Application No. 096147236, dated Jun. 7, 2012 (with English translation).

Notice of Allowance in Korean Patent Application No. 10-2011-7012918, mailed Jun. 8, 2012.

* cited by examiner

PROCESS CARTRIDGE WITH ENGAGING, URGING, AND ABUTTING PORTIONS FOR ENGAGEMENT OF THE PROCESS CARTRIDGE TO AN ELECTROPHOTOGRAPHIC IMAGE FORMING APPARATUS

This is a divisional of U.S. patent application Ser. No. 11/953,231, filed Dec. 10, 2007 now U.S. Pat. No. 8,086,135.

FIELD THE INVENTION AND RELATED ART

The present invention relates to a developing device, a process cartridge, and an electrophotographic image forming apparatus using them.

Here, the electrophotographic image forming apparatus is an apparatus for forming an image on a recording material using an electrophotographic type process. Examples of the electrophotographic image forming apparatus include an electrophotographic copying machine, an electrophotographic printer (for example, a laser beam printer, an LED printer and so on), the facsimile device, the word processor, and so on, for example.

The process cartridge is a unit which integrally contains at least a developing means and an electrophotographic photosensitive drum, and is made detachably mountable to a main assembly of an electrophotographic image forming apparatus. The developing device is a device which develops an electrostatic latent image formed on the electrophotographic photosensitive drum by a developer.

Heretofore, in the electrophotographic image forming apparatus using an electrophotographic image forming process, process means which is actable on the electrophotographic photosensitive drum and the electrophotographic photosensitive drum are unified as a cartridge. A process cartridge type in which the cartridge is detachably mountable to the electrophotographic image forming apparatus main assembly is employed. According to this process cartridge type, a maintenance operation of the device is carried out by a user, without relying on a service person, by which operativity is remarkably improved. Then, this process cartridge type is used the widely in the electrophotographic image forming apparatus.

The light corresponding to image information of a laser, LED, or a lamp is projected to the electrophotographic photosensitive drum in the electrophotographic image forming apparatus. By this, the electrostatic latent image is formed on a photosensitive drum. This electrostatic latent image is developed by the developing device. The developed image formed on the photosensitive drum is transferred onto the recording material. By this, the image is formed on the recording material.

Japanese Laid-open Patent Application 2001-255806 (Pages 9-11 FIG. 7-FIG. 14) a color electrophotographic image forming apparatus of an in-line type which arranged a plurality of process cartridges in the one array is described. A process cartridge 40 comprises a drum unit 41 which has a photosensitive drum 44, and a developing unit 42 which has a developing roller 68, and they are rotatably connected with a swing center shaft 43. The photosensitive drum 44 is provided with a cartridge coupling 60 at an axial end of the photosensitive drum 44. When the process cartridge 40 is mounted to a main assembly of the apparatus, the cartridge coupling 60 engages with a main assembly coupling 61 provided in the main assembly of the apparatus, and transmits a driving force. The driving force is transmitted to the developing roller 68 through an idler gear 65, 66 from an input gear 64 as a development driving force transmission member provided on a swing center 43 of the developing unit 42. Here, when the process cartridge 40 is mounted to the apparatus main assembly, the input gear 64 engages with a gear 67 provided in the apparatus main assembly, and receives the driving force. More particularly, drive transmissions of the photosensitive drum 44 and the developing roller 68 from the apparatus main assembly are performed independently from each other.

SUMMARY OF THE INVENTION

Recently, the improvement of a further image quality is demand. In a conventional example, an input gear is provided at a swing center which is constant in the position irrespective of the swinging movement of the developing unit. Therefore, the drive transmission is carried out to a developing roller through an idler gear from the input gear, and it is necessary to provide a space for it in a process cartridge. Therefore, a rotational accuracy of the developing roller is influenced by the engagement among the input gear, the idler gear and a main assembly gear.

The present invention further develops a prior art structures described above.

Accordingly and it is a principal object of the present invention to provide a developing apparatus, process cartridge and an electrophotographic image forming apparatus, and wherein the process cartridge or the developing device is positioned by moving a movable member in the direction crossing with a longitudinal direction of the process cartridge or a developing device and wherein a retraction mechanism for a main assembly driving force transmitting member for transmitting a rotational driving force to the developing roller is simplified.

It is another object of the present invention to provide a developing apparatus, a process cartridge and an electrophotographic image forming apparatus, wherein an engaging portion provided in a shaft coupling member, and wherein by positioning an engaging portion provided in a shaft coupling member to a holding portion, a large guide for engagement to the engaging portion and the main assembly driving force transmitting member is unnecessary, and the developing device, the process cartridge, and an electrophotographic image forming apparatus are downsized.

It is a further object of the present invention to provide a developing apparatus, a process cartridge and an electrophotographic image forming apparatus wherein the image quality is improved by improving the rotational accuracy of the developing roller.

According to an aspect of the present invention, there is provided a process cartridge detachably mountable to a main assembly of the electrophotographic image forming apparatus, said main assembly of the electrophotographic image forming apparatus including a first rotatable main assembly driving force transmission member, a second rotatable main assembly driving force transmission member, a main assembly positioning portion for positioning said process cartridge, a movable member movable between a first position for permitting said process cartridge to enter the main assembly of the electrophotographic image forming apparatus in a longitudinal direction of said process cartridge and a second position for urging said process cartridge in a direction crossing and the longitudinal direction to position said process cartridge to the main assembly positioning portion, and a main assembly locking member, said process cartridge comprising an electrophotographic photosensitive drum; a developing roller for developing an electrostatic latent image formed on said electrophotographic photosensitive drum with a developer; a drum coupling member, provided on one axial end of said electrophotographic photosensitive drum, for engaging with the first main assembly drive transmission member and transmitting a first rotational driving force to the electrophotographic photosensitive drum, when said process cartridge is mounted to the main assembly of the apparatus; a shaft coupling member, provided on one axial end of said developing roller, for transmitting a second rotational driving force from the second main assembly driving force transmission member with a deviation permitted between an axis of the second main assembly drive transmission member and an axis of said developing roller, wherein said shaft coupling member includes an engaging portion for engaging with the second main assembly drive transmission member and receiving the second rotational driving force, when said process cartridge is mounted to the main assembly of the apparatus; said engaging portion is movable in a direction crossing with the axial direction of said developing roller; when said process cartridge enters said main assembly of the apparatus, said engaging portion is positioned to a holding portion provided in said process cartridge; when said process cartridge is moved by movement said movable member from the first position to the second position, said engaging portion is positioned to the main assembly locking member; and a distance between an axis of said engaging portion and an axis of said developing roller is smaller when said process cartridge is positioned to the main assembly positioning portion than when said engaging portion is positioned by said holding portion.

According to another aspect of the present invention, there is provided an electrophotographic image forming apparatus for forming an image on a recording material, said electrophotographic image forming apparatus comprising (a) a first rotatable main assembly driving force transmission member and a second rotatable main assembly driving force transmission member; (b) a main assembly positioning portion for positioning said process cartridge; a movable member movable between a first position for permitting said process cartridge to enter the main assembly of the apparatus of said electrophotographic image forming apparatus in a longitudinal direction of said process cartridge, and a second position for urging said process cartridge in a direction crossing with the longitudinal direction to position said process cartridge to the main assembly positioning portion; (d) a main assembly locking member; (e) said process cartridge detachably mounted to the main assembly of the apparatus including, an electrophotographic photosensitive drum; a developing roller for developing an electrostatic latent image formed on said electrophotographic photosensitive drum with a developer; a drum coupling member, provided on one axial end of said electrophotographic photosensitive drum, for engaging with the first main assembly drive transmission member and transmitting a first rotational driving force to the electrophotographic photosensitive drum, when said process cartridge is mounted to the main assembly of the apparatus; a shaft coupling member, provided on one axial end of said developing roller, for transmitting a second rotational driving force from the second main assembly driving force transmission member with a deviation permitted between an axis of the second main assembly drive transmission member and an axis of said developing roller, wherein said shaft coupling member includes an engaging portion for engaging with the second main assembly drive transmission member and receiving the second rotational driving force, when said process cartridge is mounted to the main assembly of the apparatus; said engaging portion is movable in a direction crossing with the axial direction of said developing roller; when said process cartridge enters said main assembly of the apparatus, said engaging portion is positioned to a holding portion provided in said process cartridge; when said process cartridge is moved by movement said movable member from the first position to the second position, said engaging portion is positioned to the main assembly locking member; and a distance between. an axis of said engaging portion and an axis of said developing roller is smaller when said process cartridge is positioned to the main assembly positioning portion than when said engaging portion is positioned by said holding portion; and (f) feeding means for feeding the recording material.

These and other objects, features, and advantages of the present invention will become more apparent upon consideration of the following description of the preferred embodiments of the present invention, taken in conjunction with the accompanying drawings.

BRIER DESCRIPTION OF THE DRAWINGS

Figure 3A:
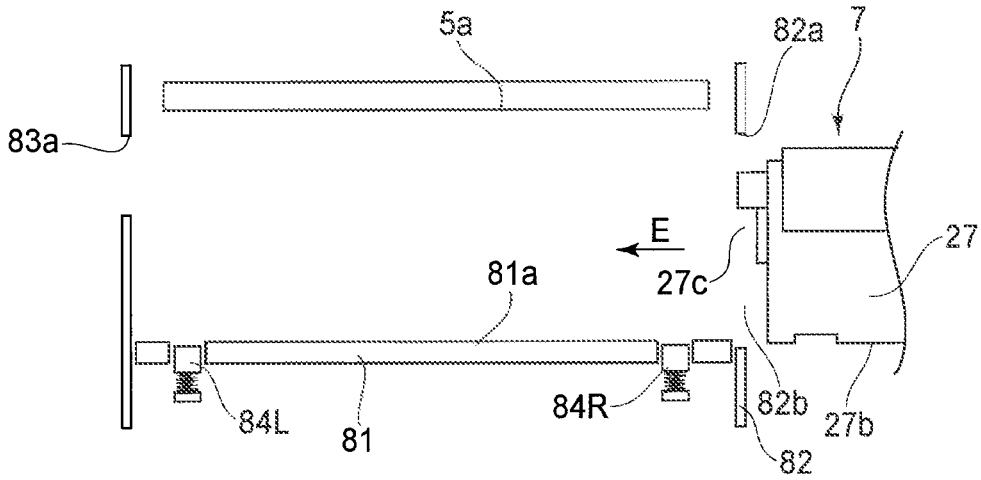

FIG. 3*a* is an illustration of a mounting operation, to a main assembly of the apparatus, of the process cartridge.

Figure 3B:
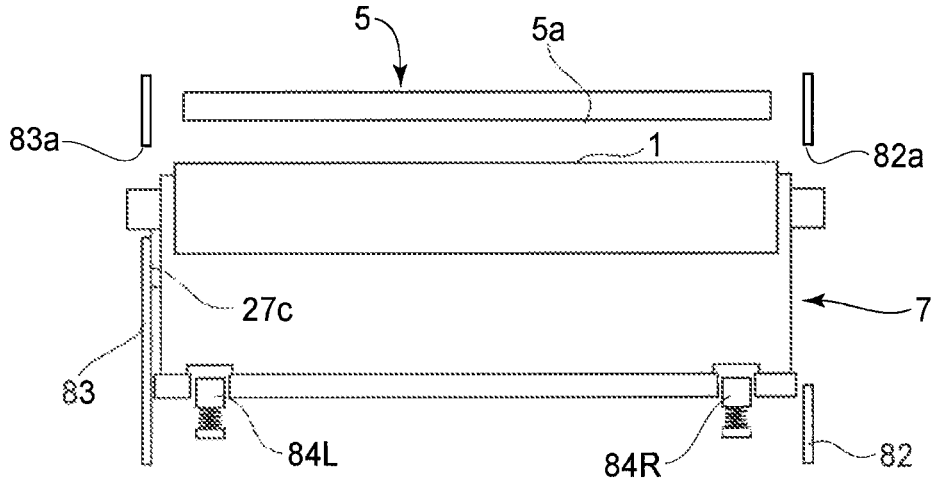

FIG. 3*b* is an illustration of the mounting operation, to the main assembly of the apparatus, of the process cartridge.

Figure 3C:
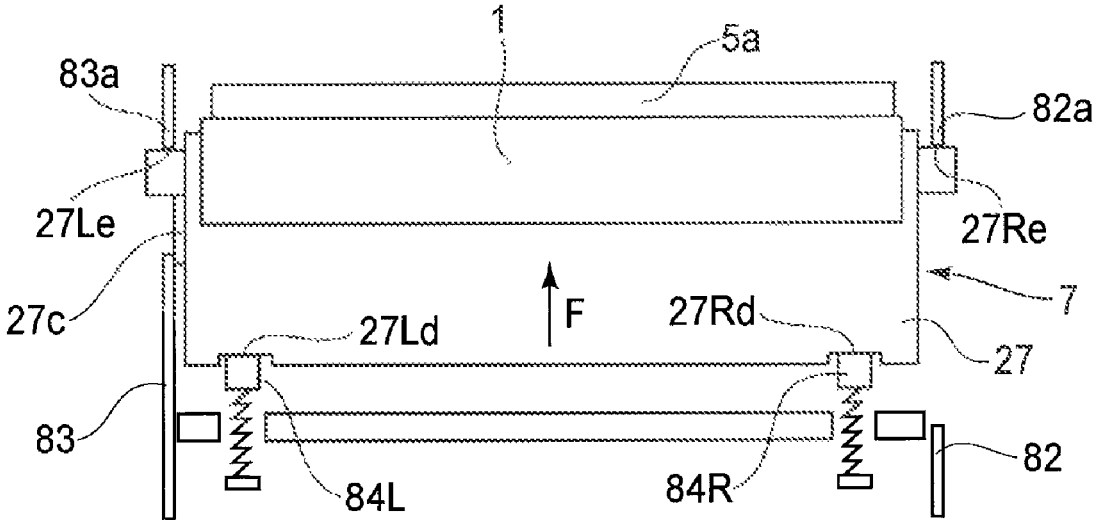

FIG. 3*c* is an illustration of the mounting operation, to the main assembly of the apparatus, of the process cartridge.

Figure 4:
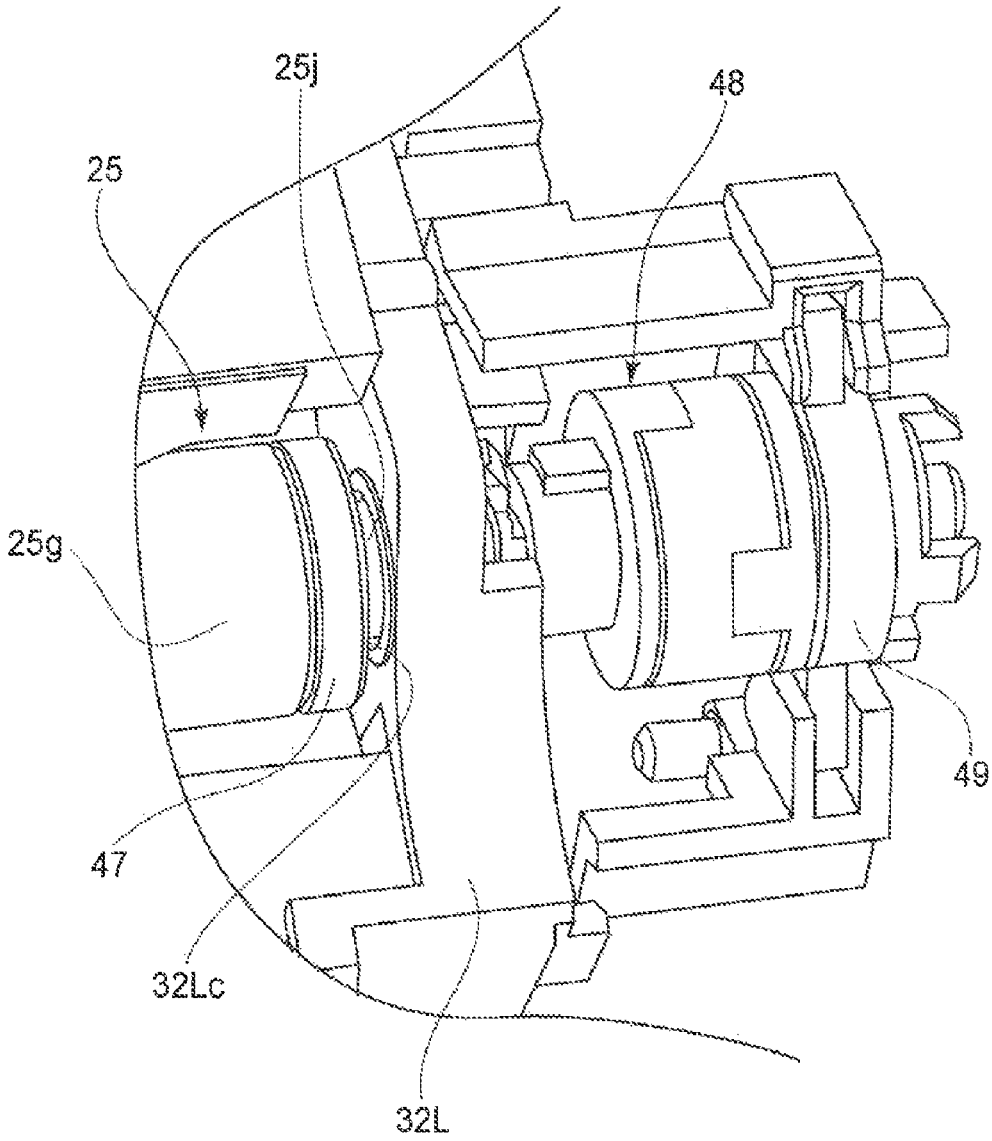

FIG. 4 is an illustration of a supporting structure for a developing roller.

Figure 5:
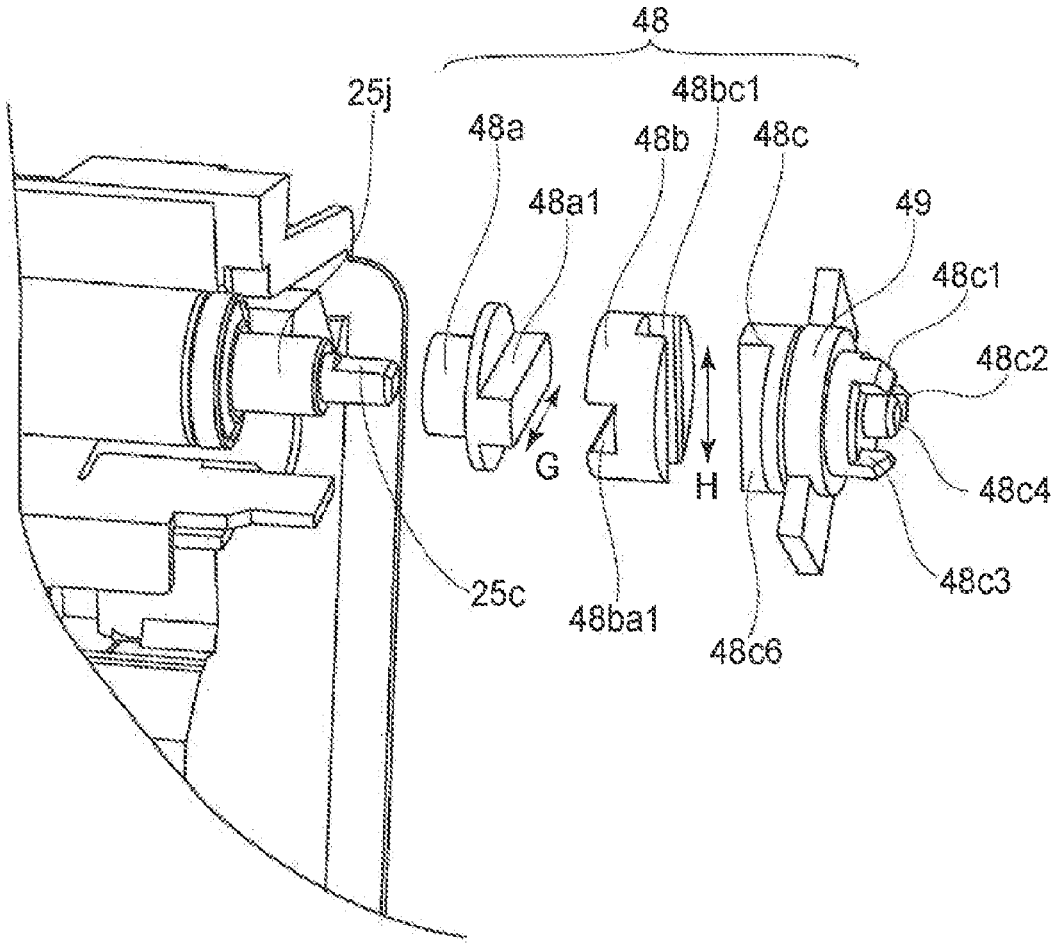

FIG. 5 is an illustration of a structure of an Oldham coupling.

Figure 6A:
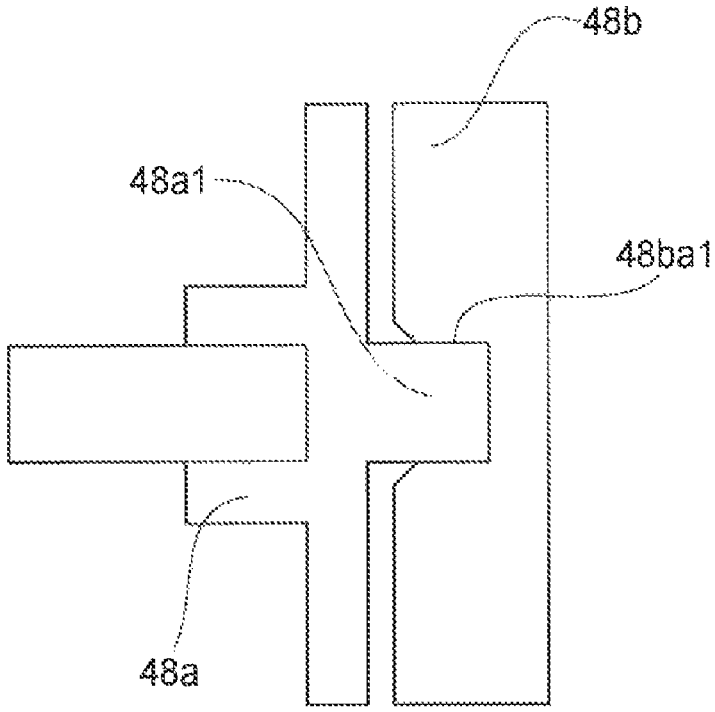

FIG. 6*a* is a cross-sectional illustration of the Oldham coupling.

Figure 6B:
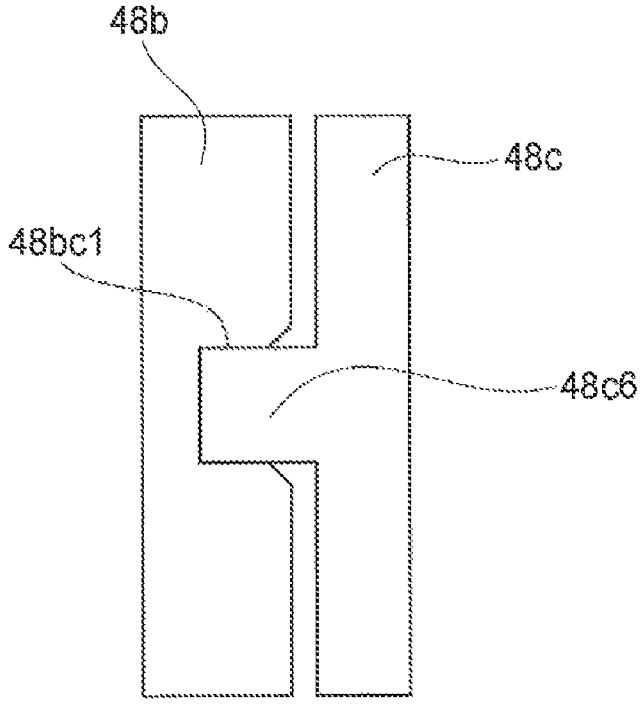

FIG. 6*b* is a cross-sectional illustration of the Oldham coupling.

Figure 7A:
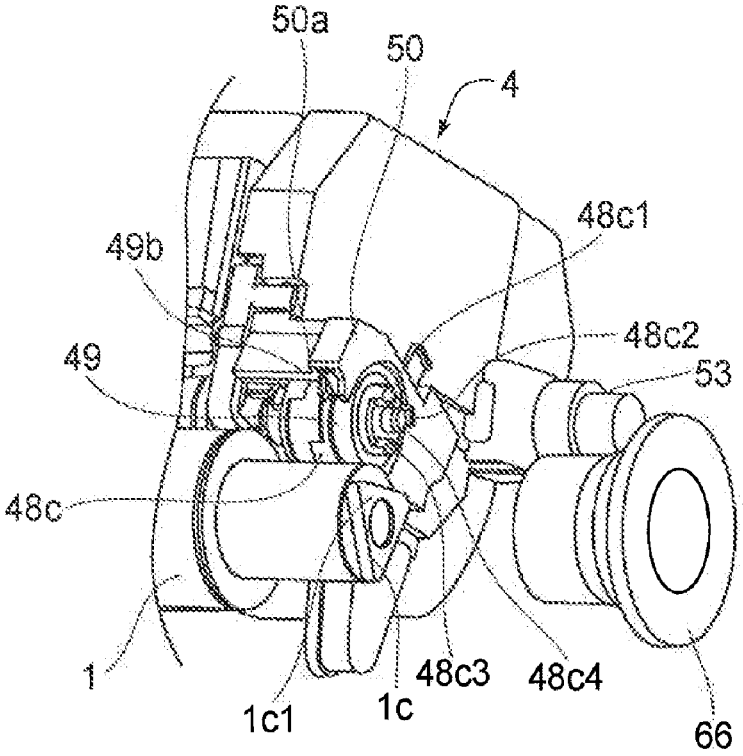

FIG. 7*a* is an illustration of the structure of a coupling in the process cartridge and the main assembly of the apparatus.

Figure 7B:
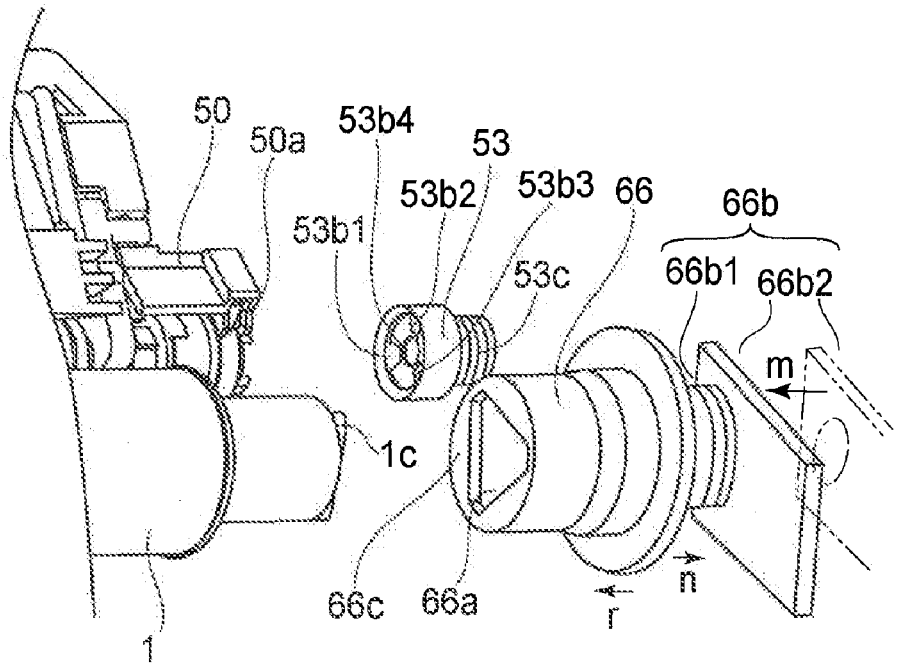

FIG. 7*b* is an illustration of the structure of the coupling in the process cartridge and the main assembly of the apparatus.

Figure 8A:
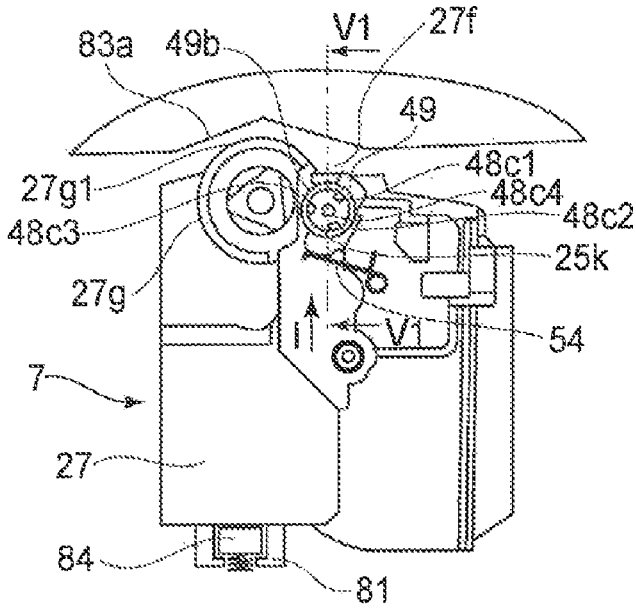

FIG. 8*a* is an illustration of the state of the Oldham coupling at the time of mounting the process cartridge in a first embodiment to a main assembly of the image forming apparatus.

Figure 8B:
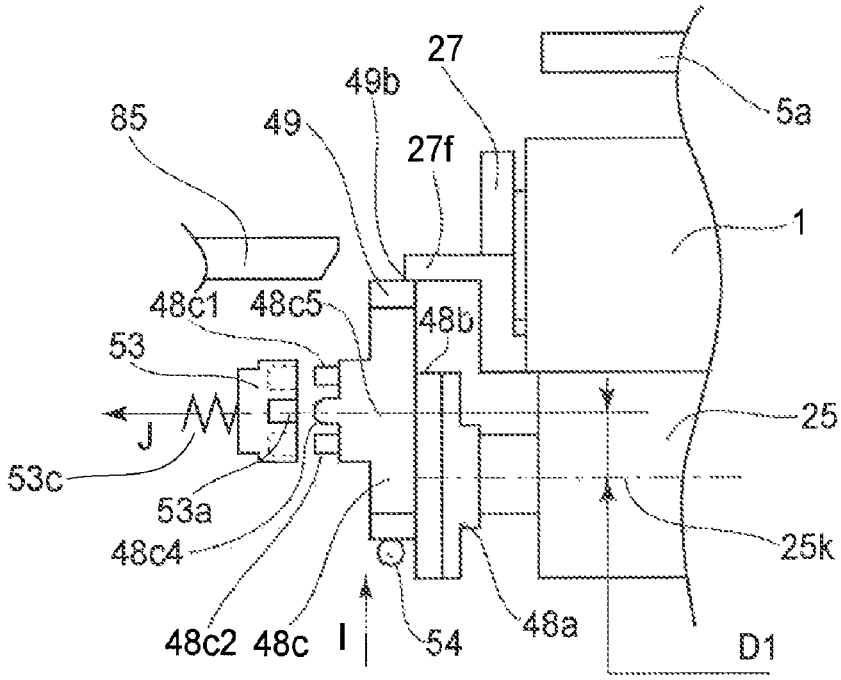

FIG. 8*b* is an illustration. of the state of the Oldham coupling at the time of mounting the process cartridge in the first embodiment to the main assembly of the image forming apparatus.

Figure 9A:
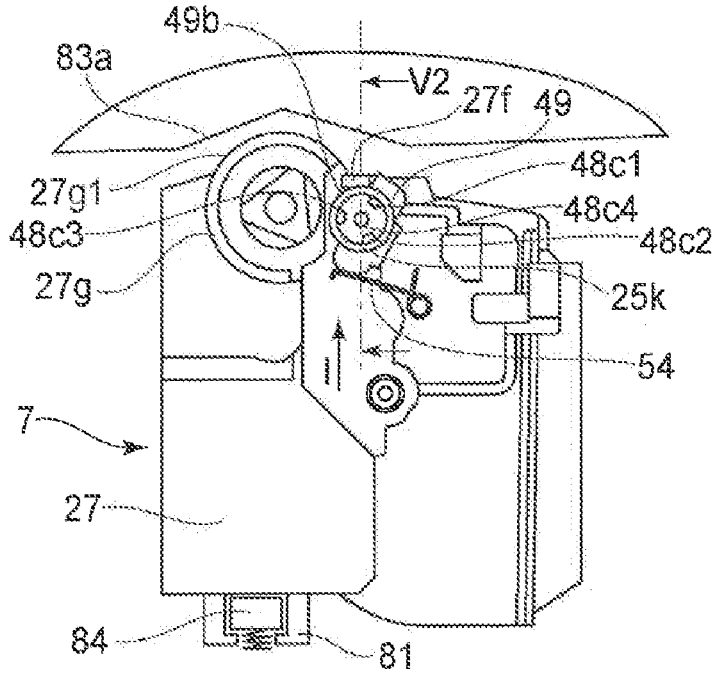

FIG. 9*a* is an illustration of the state of the Oldham coupling at the time of mounting the process cartridge in the first embodiment to the main is assembly of the image forming apparatus.

Figure 9B:
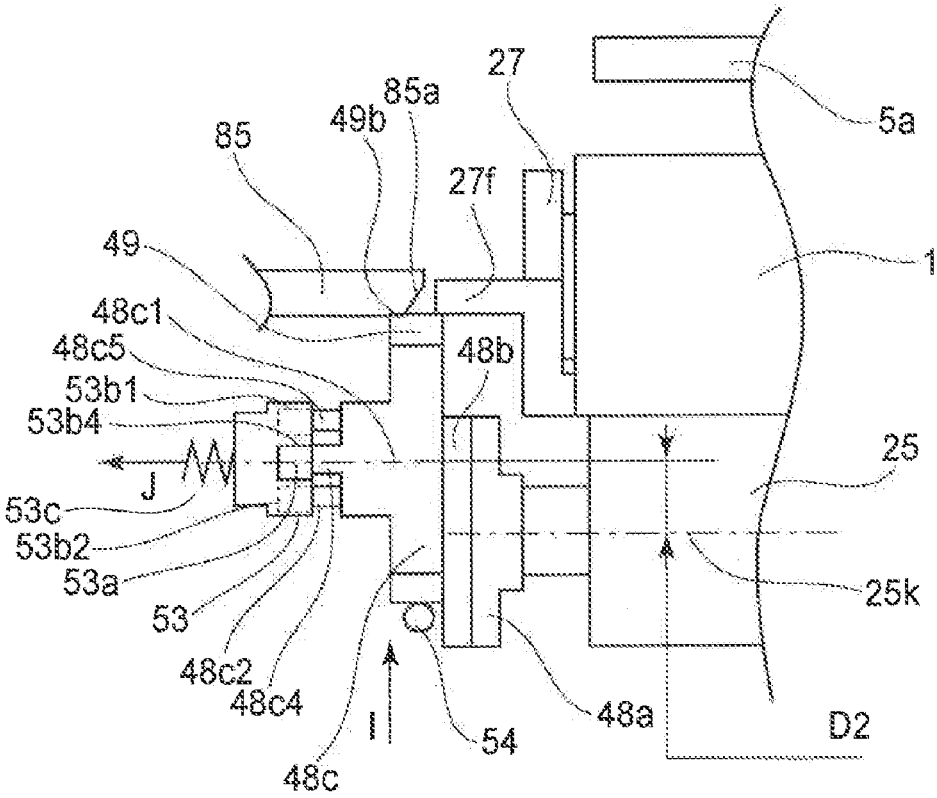

FIG. 9*b* is an illustration of the state of the Oldham coupling at the time of mounting the process cartridge in the first embodiment to the main assembly of the image forming apparatus.

Figure 9C:
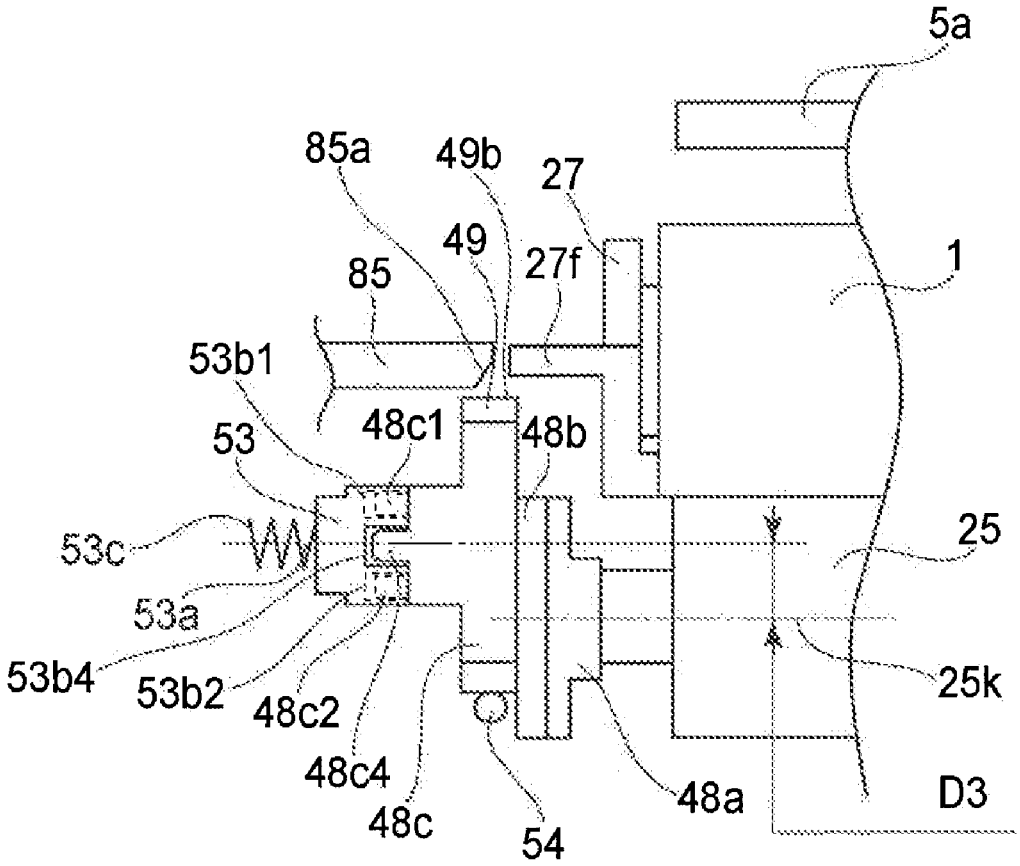

FIG. 9*c* is an illustration of the state of the Oldham coupling at the time of mounting the process cartridge in the first embodiment to the main assembly of the image forming apparatus.

Figure 10A:
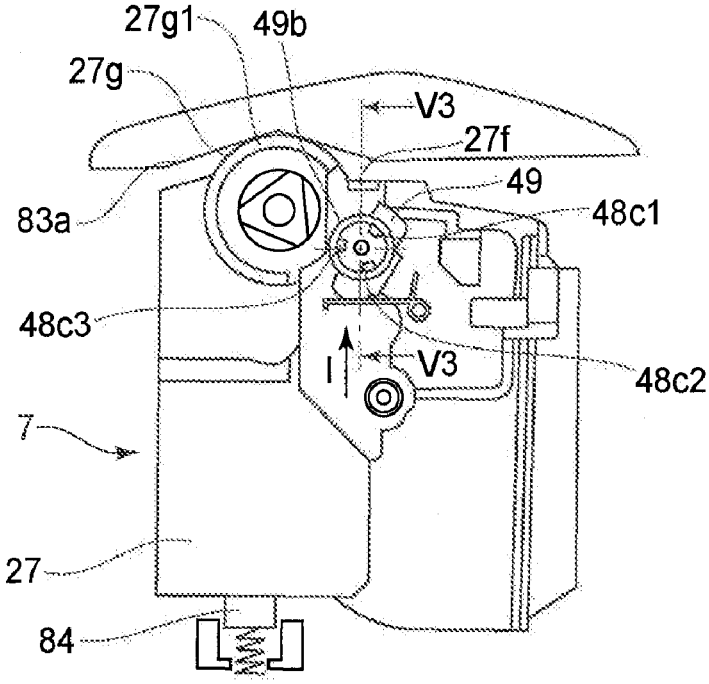

FIG. 10*a* is an illustration of the state of the Oldham coupling at a time of positioning in the main assembly of the image forming apparatus about the process cartridge in the first embodiment.

Figure 10B:
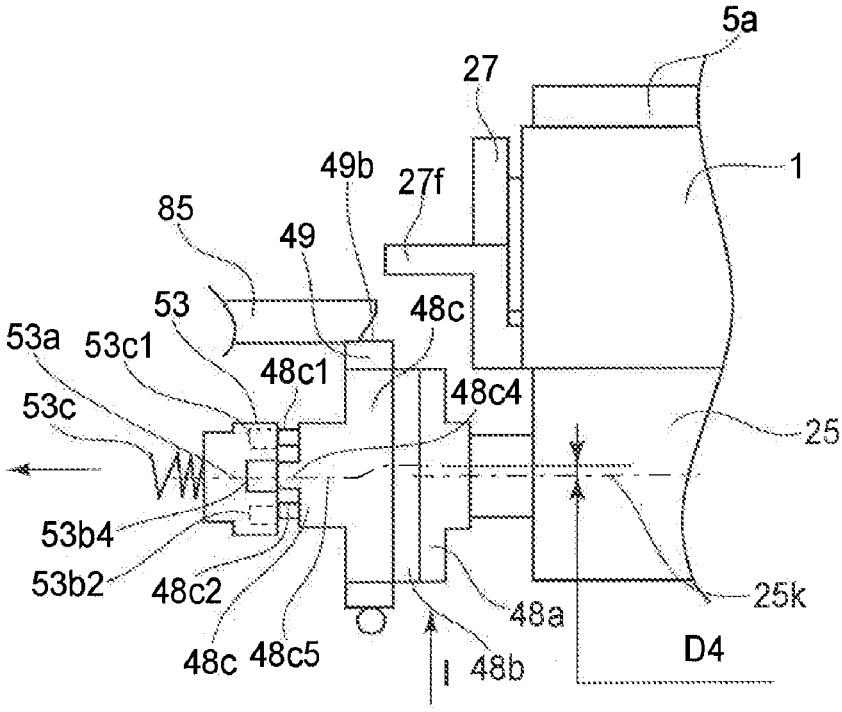

FIG. 10*b* is an illustration of the state of the Oldham coupling at the time of positioning the process cartridge in the first embodiment in the main assembly of the image forming apparatus.

Figure 10C:
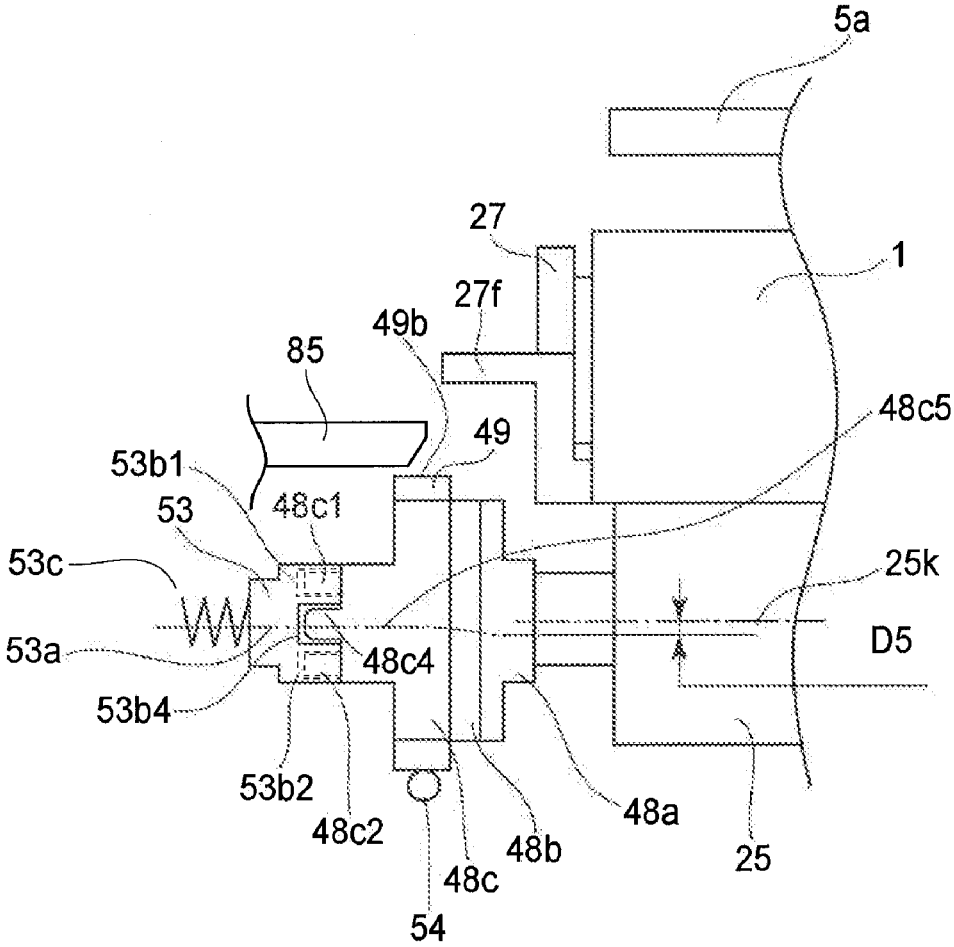

FIG. 10*c* is an illustration of the state of the Oldham coupling at the time of positioning the process cartridge in the first embodiment in the main assembly of the image forming apparatus.

Figure 11A:
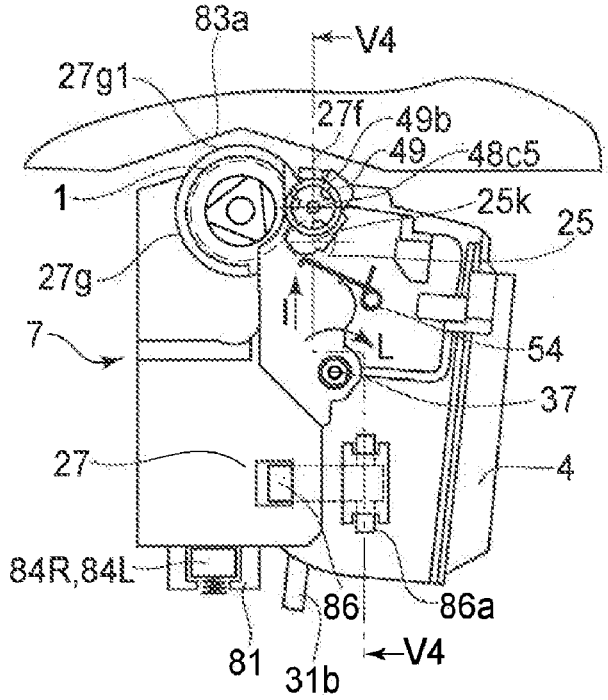

FIG. 11*a* is an illustration of the state of s the Oldham coupling at the time of Mounting the process cartridge in a second embodiment to the main assembly of the image forming apparatus.

Figure 11B:
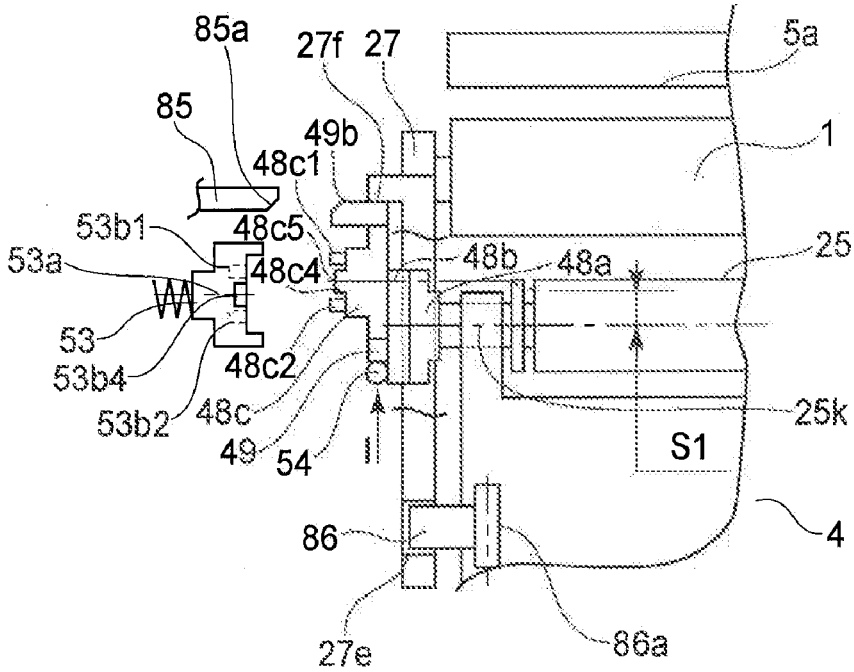

FIG. 11*b* is an illustration of the state of the Oldham coupling at the time of mounting the process cartridge in the second embodiment to the main assembly of the image forming apparatus.

Figure 12A:
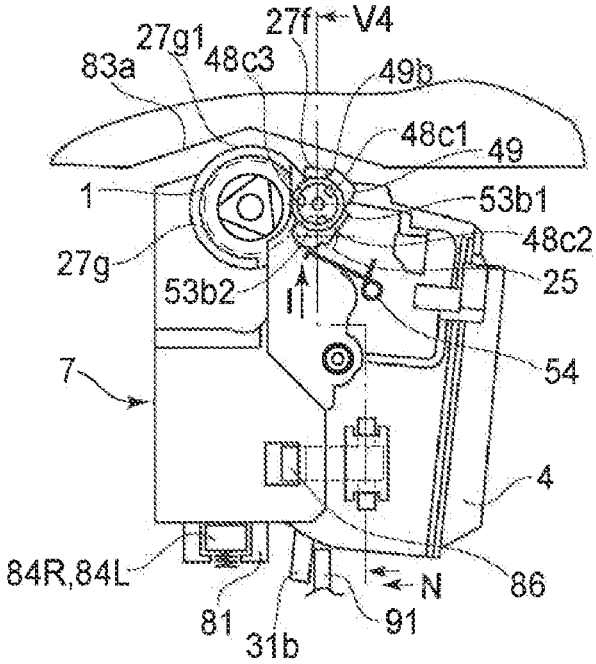

FIG. 12*a* is an illustration of the state of the Oldham coupling at the time of mounting the process cartridge in the second embodiment to the main assembly of the image forming apparatus.

Figure 12B:
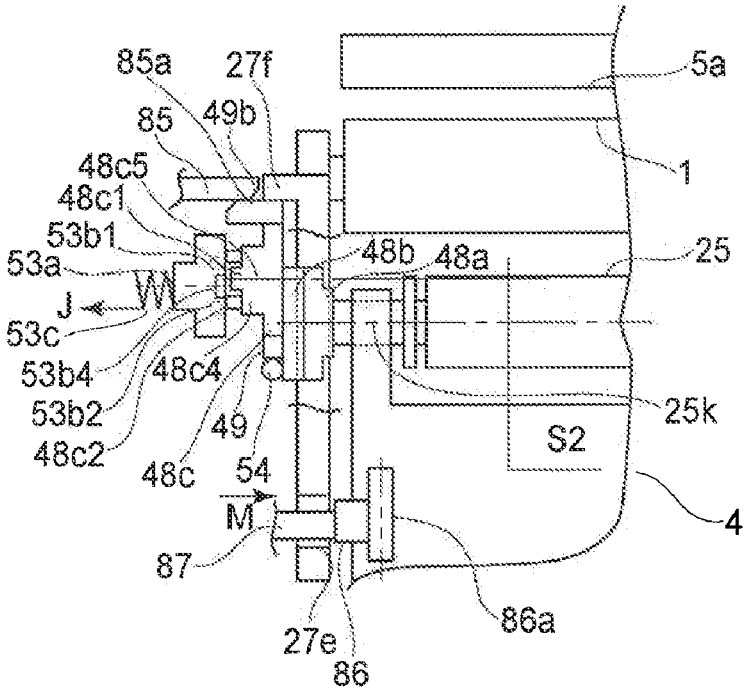

FIG. 12*b* is an illustration of the state of the Oldham coupling at the time of mounting the process cartridge in the second embodiment to the main assembly of the image forming apparatus.

Figure 13A:
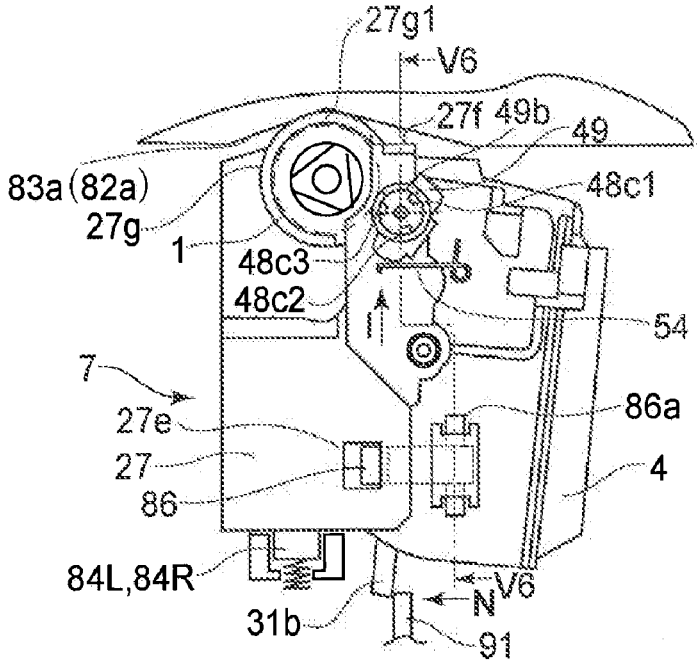

FIG. 13*a* is an illustration of the state of the Oldham coupling at the time of positioning the process cartridge in the second embodiment in the main assembly of the image forming apparatus.

Figure 13B:
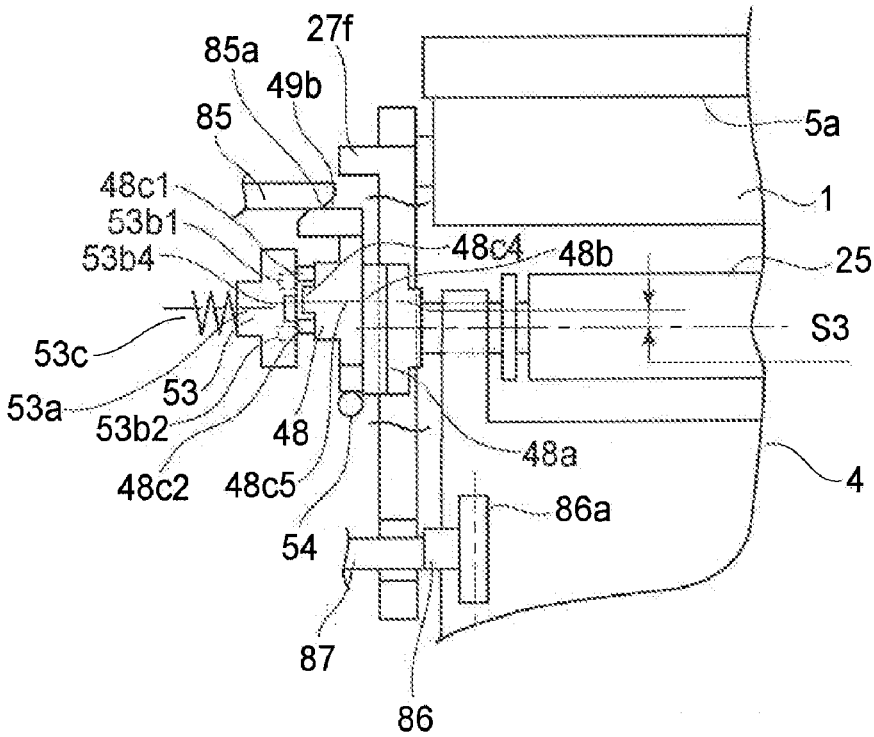

FIG. 13*b* is an illustration of the state of the Oldham coupling at the time of positioning the process cartridge in the second embodiment in the main assembly of the image forming apparatus.

Figure 14A:
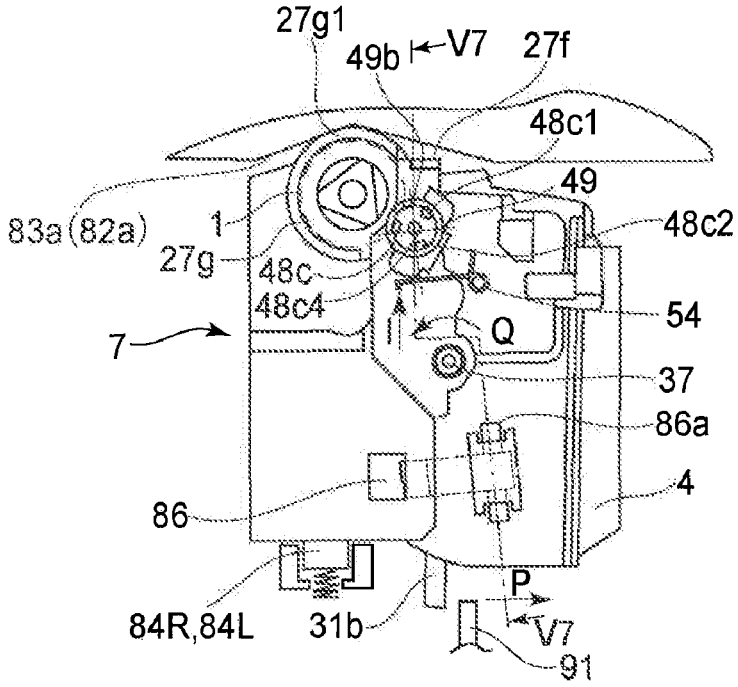

FIG. 14*a* is an illustration of the state of the Oldham coupling at the time of positioning the process cartridge in the second embodiment in the main assembly of the image forming apparatus.

Figure 14B:
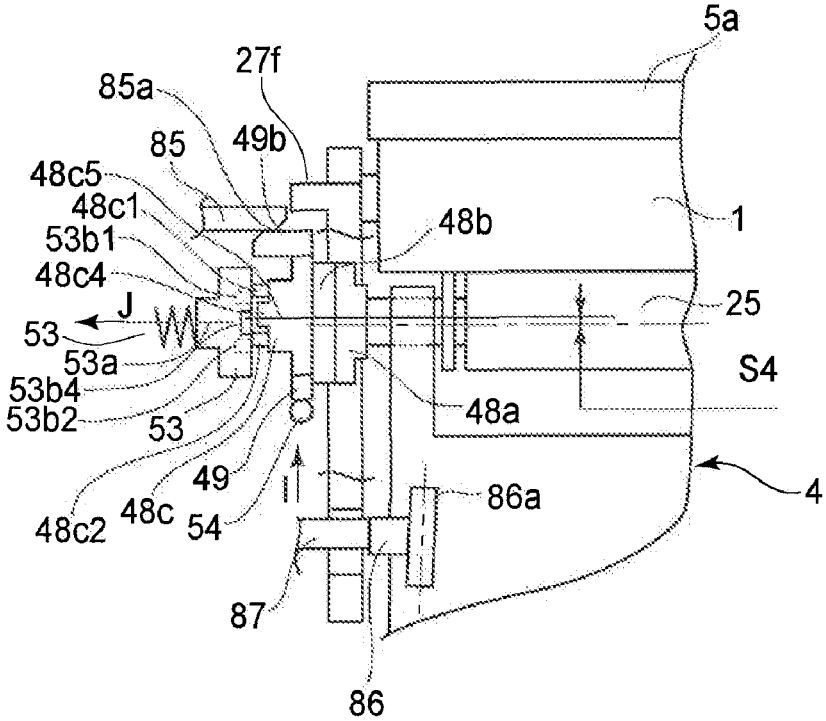

FIG. 14*b* is an illustration of the state of the Oldham coupling at the time of positioning the process cartridge in the second embodiment in the main assembly of the image forming apparatus.

Figure 15A:
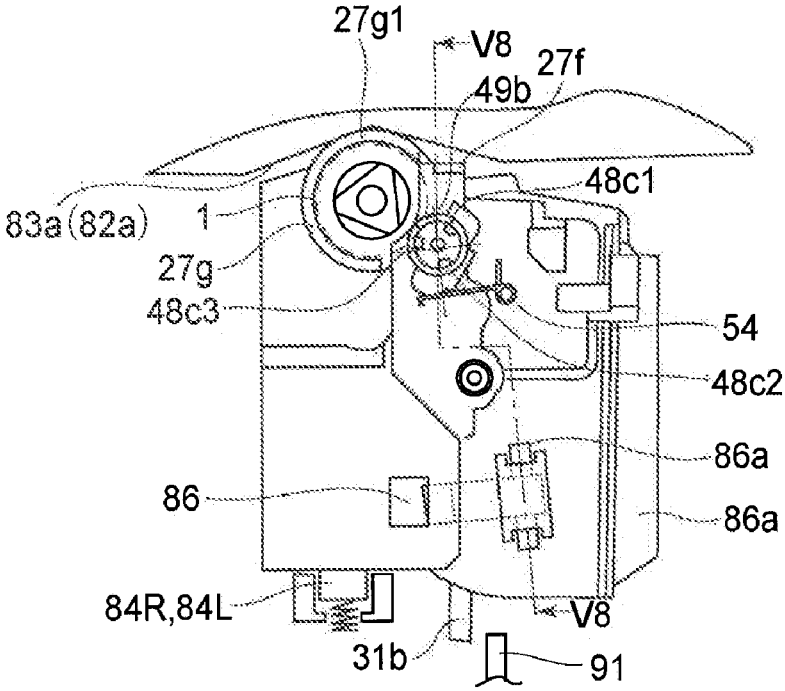

FIG. 15*a* is an illustration of the state of the Oldham coupling at the time of an image formation in the second embodiment.

Figure 15B:
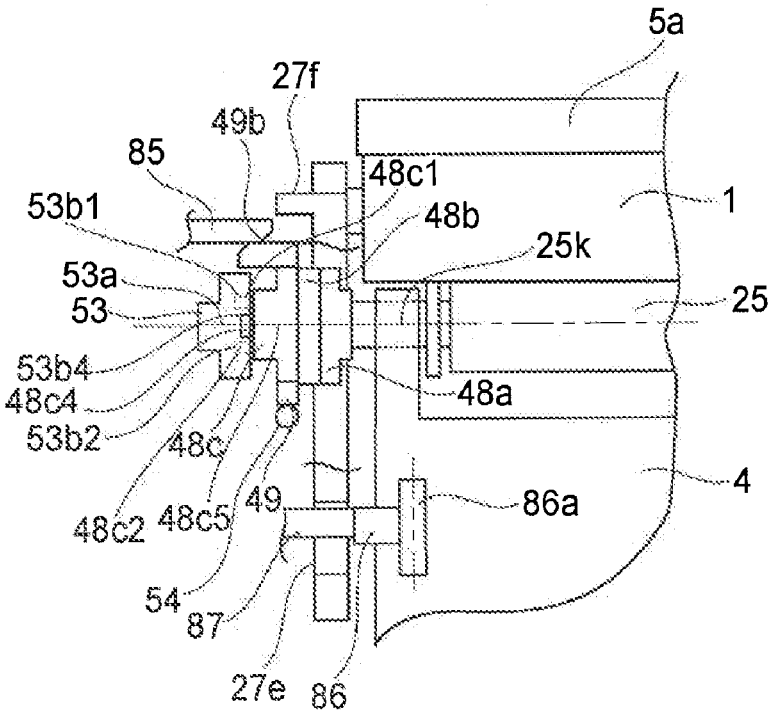

FIG. 15*b* is an illustration of the state of the Oldham coupling at the time of the image formation in the second embodiment.

Figure 16:
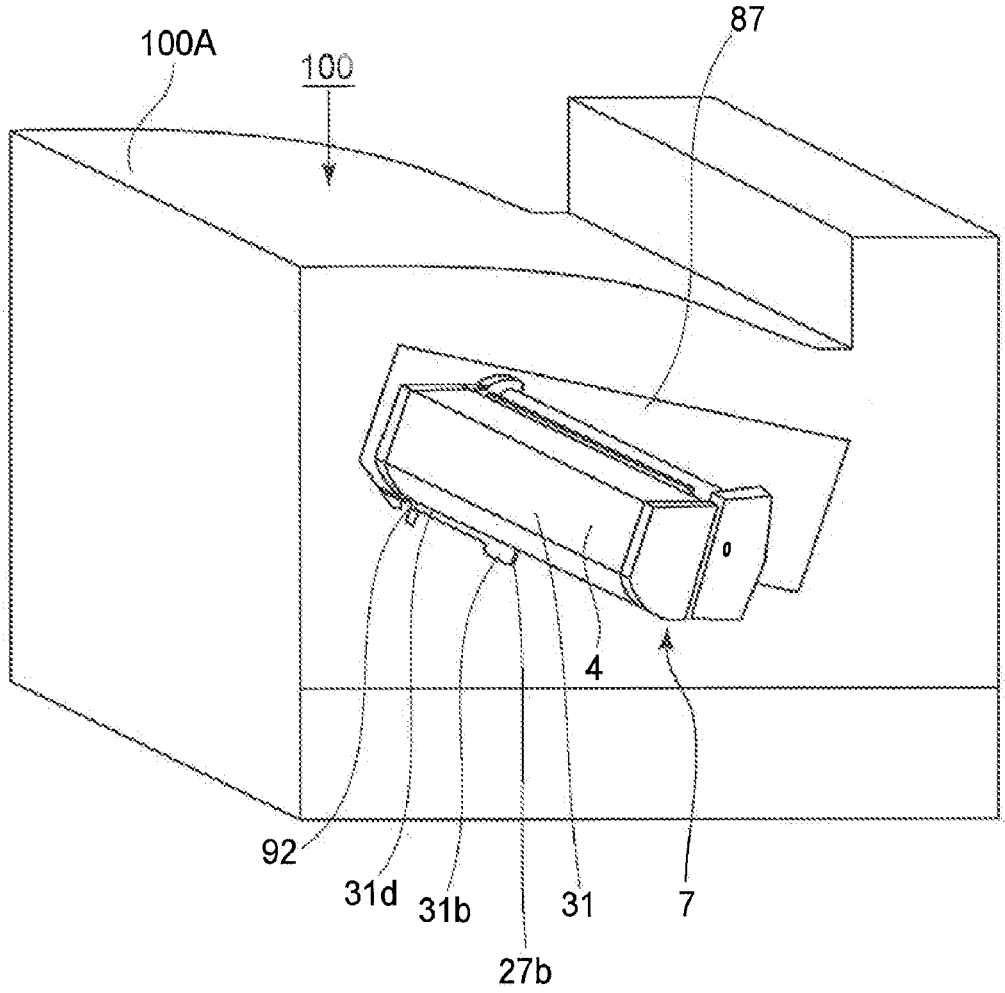

FIG. 16 is the Figure showing an electrophotographic image forming apparatus in a third embodiment.

Figure 17:
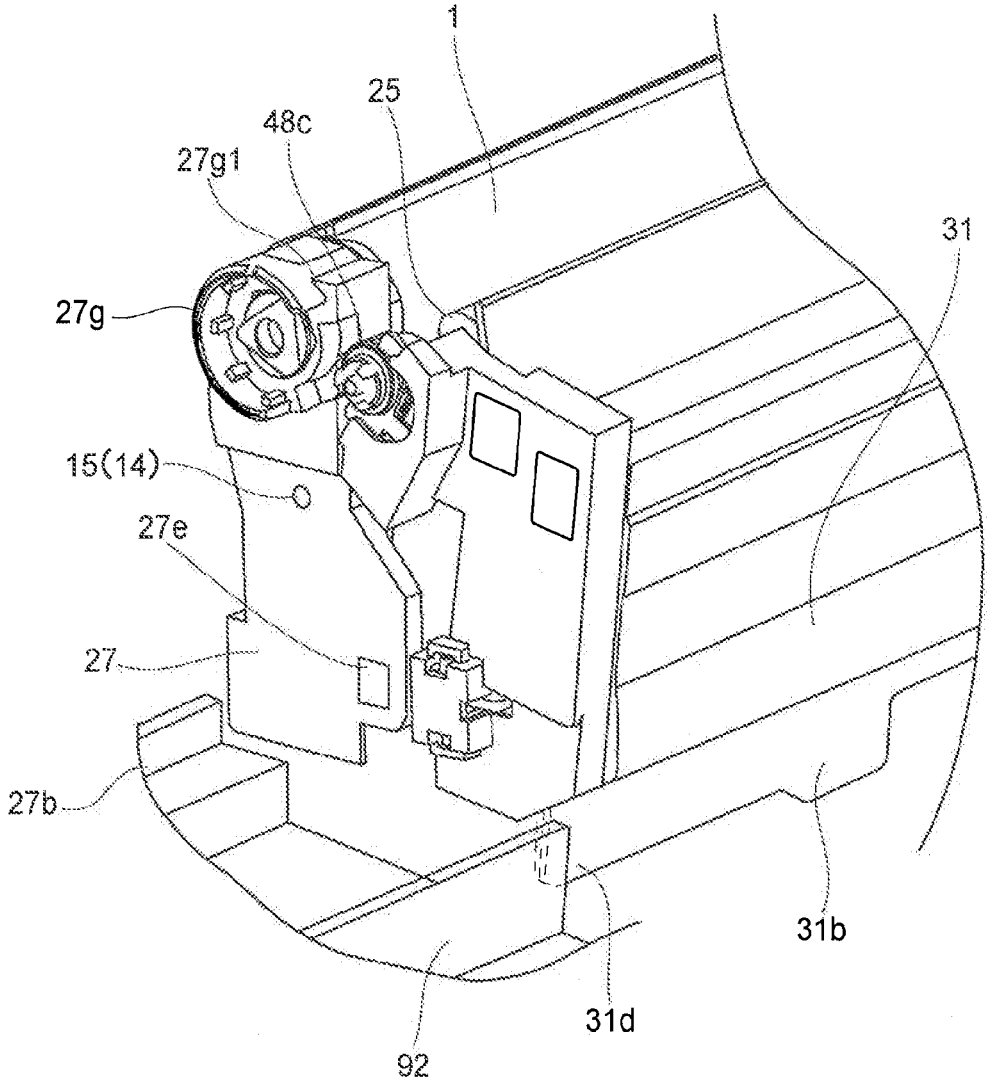

FIG. 17 is an illustration in the state of mounting the process cartridge in the third embodiment to the main assembly of the image forming apparatus.

Figure 18A:
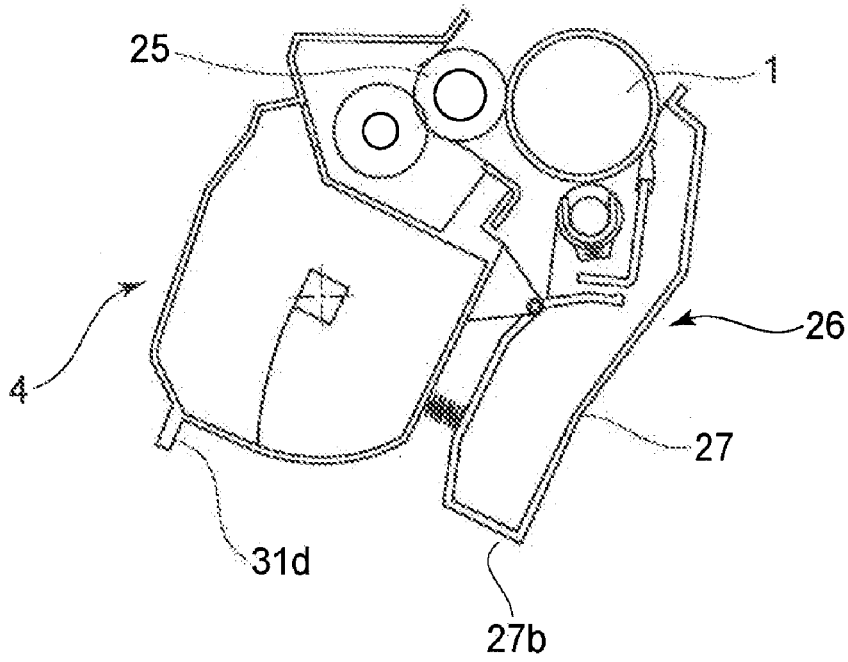

FIG. 18*a* is an illustration in the state of mounting the process cartridge in the third embodiment to the main assembly of the image forming apparatus.

Figure 18B:
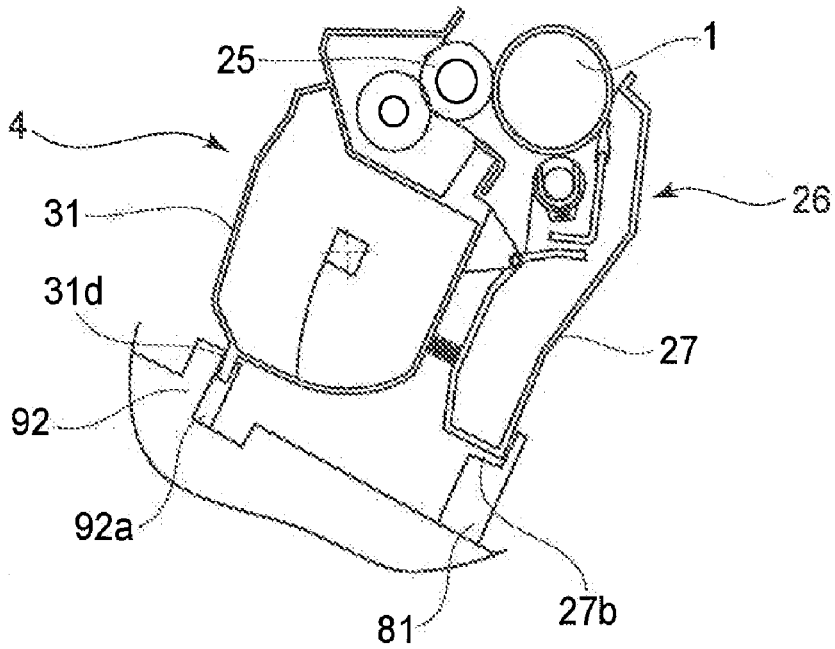

FIG. 18*b* is an illustration in the state of mounting the process cartridge in the third embodiment to the main assembly of the image forming apparatus.

Figure 18C:
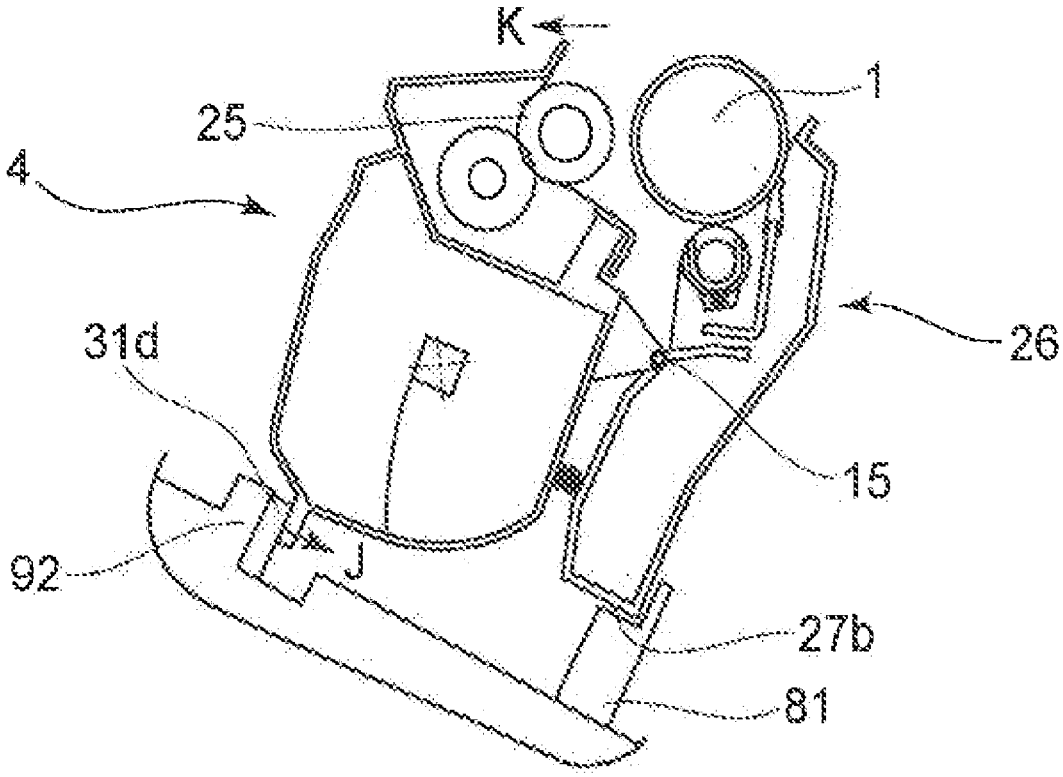

FIG. 18*c* is an illustration in the state of mounting the process cartridge in the third embodiment to the main assembly of the image forming apparatus.

Figure 19:
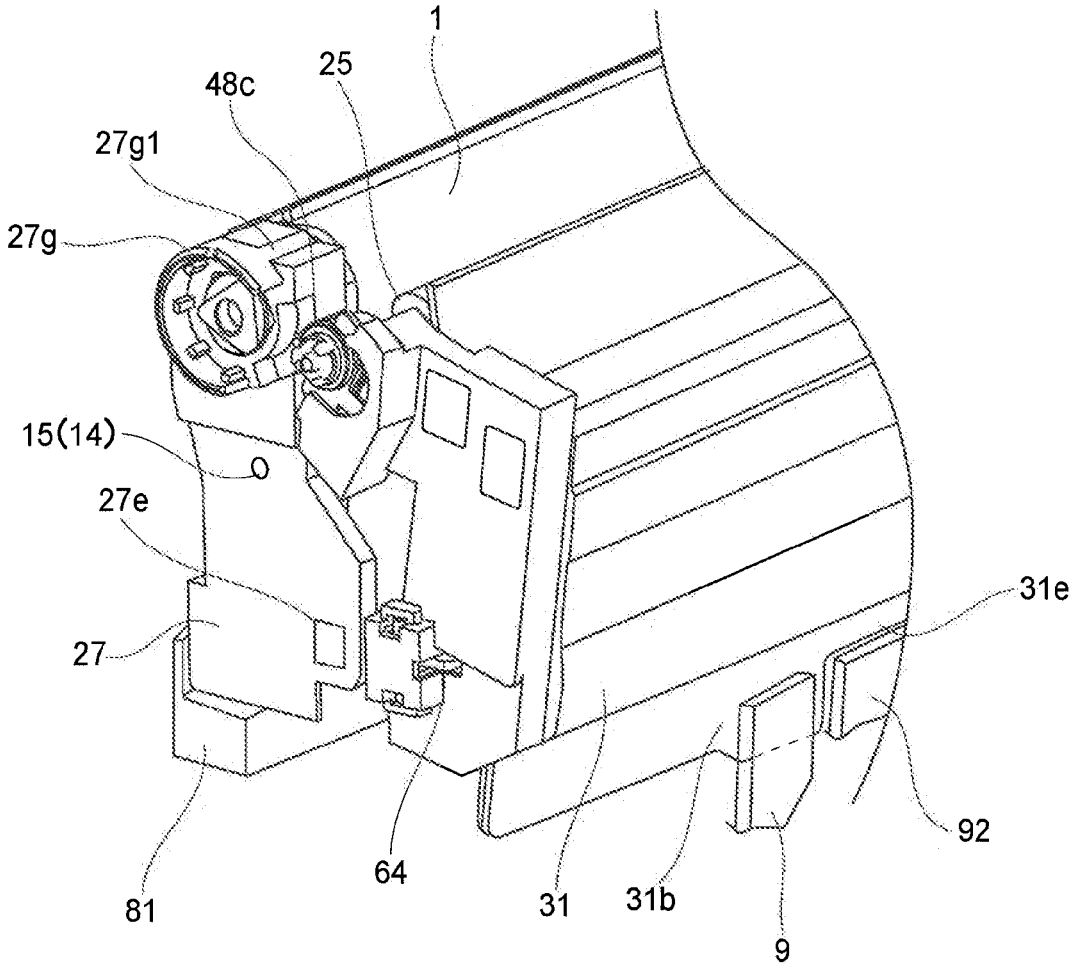

FIG. 19 is an illustration in the state of mounting the process cartridge in the third embodiment to the main assembly of the image forming apparatus.

Figure 20A:
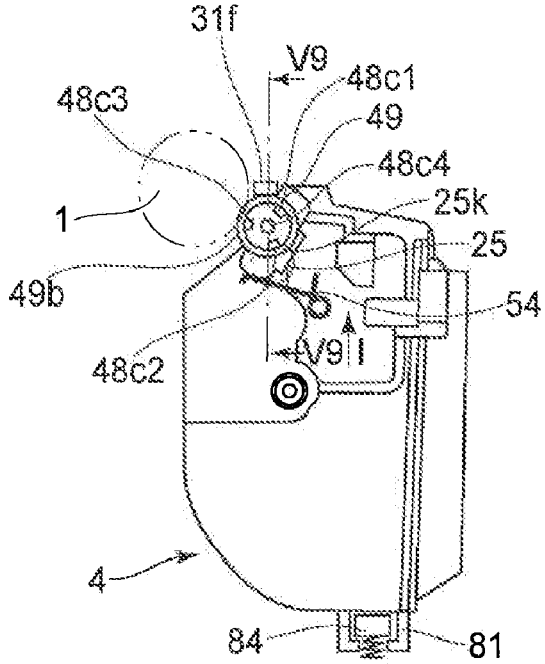

FIG. 20*a* is an illustration of the state of the Oldham coupling at the time of mounting a developing device in a fourth embodiment to the main assembly of the image forming apparatus.

Figure 20B:
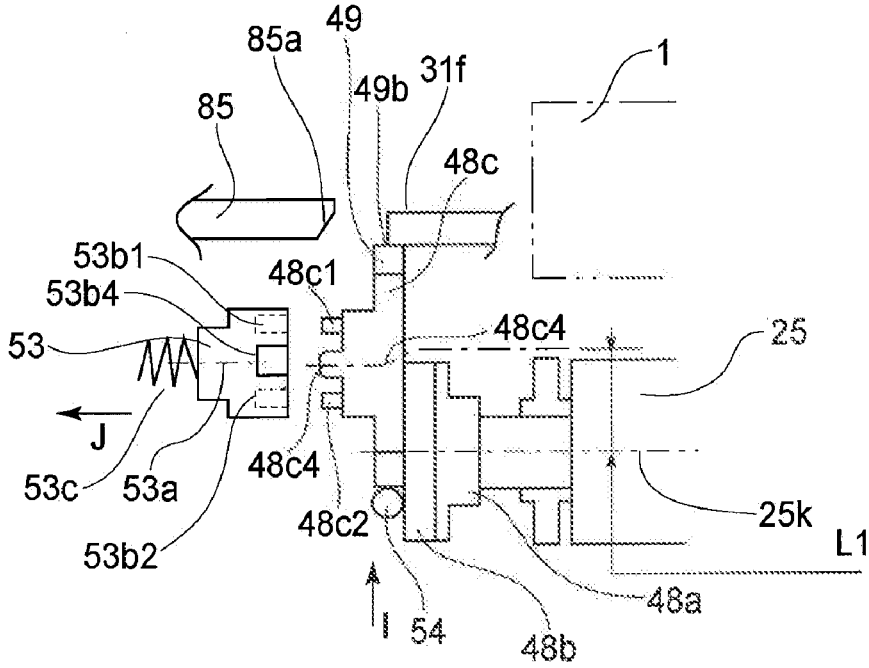

FIG. 20*b* is an illustration of the state of the Oldham coupling at the time of mounting the developing device in the fourth embodiment to the main assembly of the image forming apparatus.

Figure 21A:
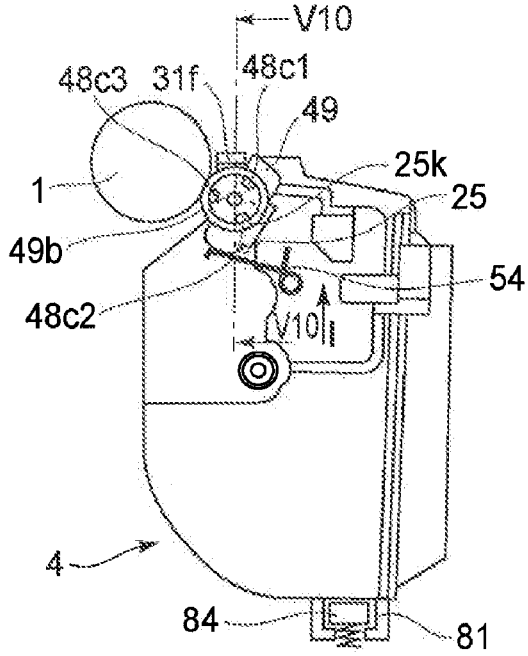

FIG. 21*a* is an illustration of the state of the Oldham coupling at the time of mounting the developing device in the fourth embodiment to the main assembly of the image forming apparatus.

Figure 21B:
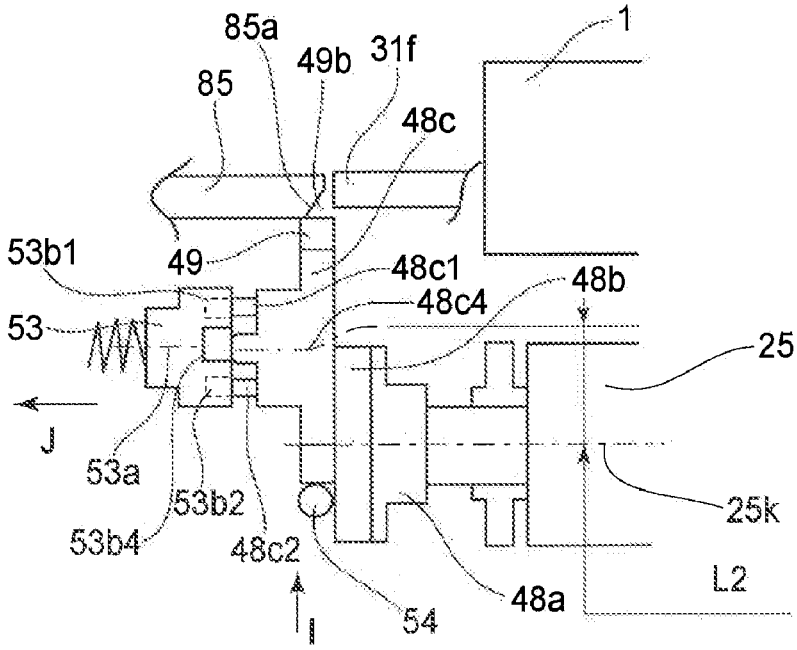

FIG. 21*b* is an illustration of the state of the Oldham coupling at the time of mounting the developing device in the fourth embodiment to the main assembly of the image forming apparatus.

Figure 22A:
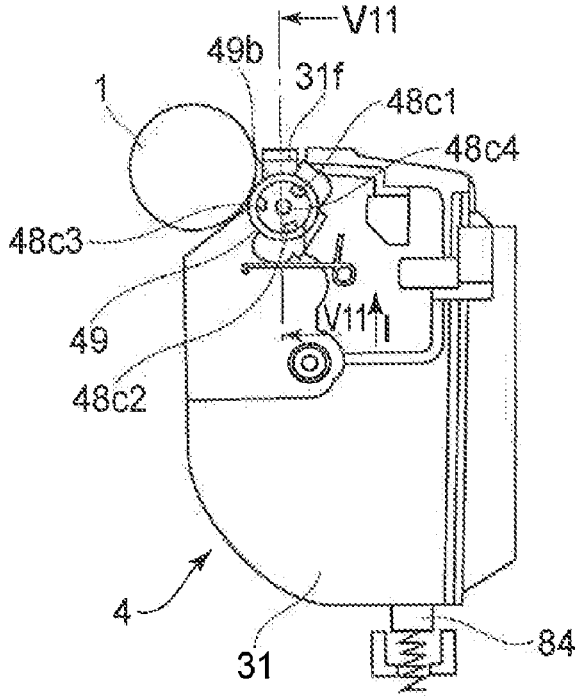

FIG. 22*a* is an illustration of the state of the Oldham coupling at the time of positioning the developing device in the fourth embodiment in the main assembly of the image forming apparatus.

Figure 22B:
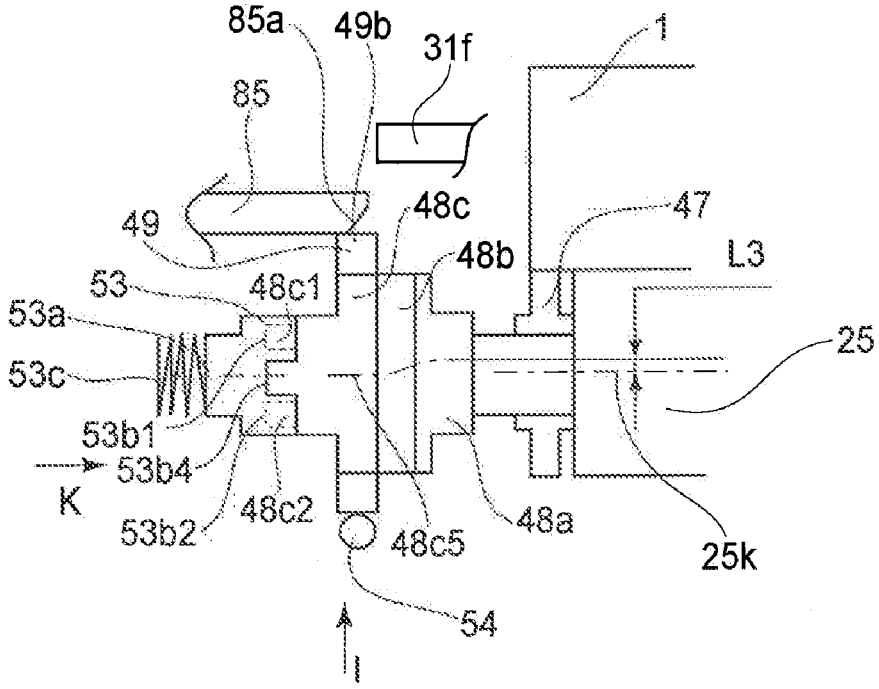

FIG. 22*b* is an illustration of the state of the Oldham coupling at the time of positioning the developing device in the fourth embodiment in the main assembly of the image forming apparatus.

DETAILED DESCRIPTION OF THE PREFERRED EMBODIMENTS

The First Embodiment:

The embodiment of the process cartridge and a color electrophotographic image forming apparatus (image forming apparatus) according to a first embodiment of the present invention will be described.

(General Arrangement of Image Forming Apparatus)

Figure 1:
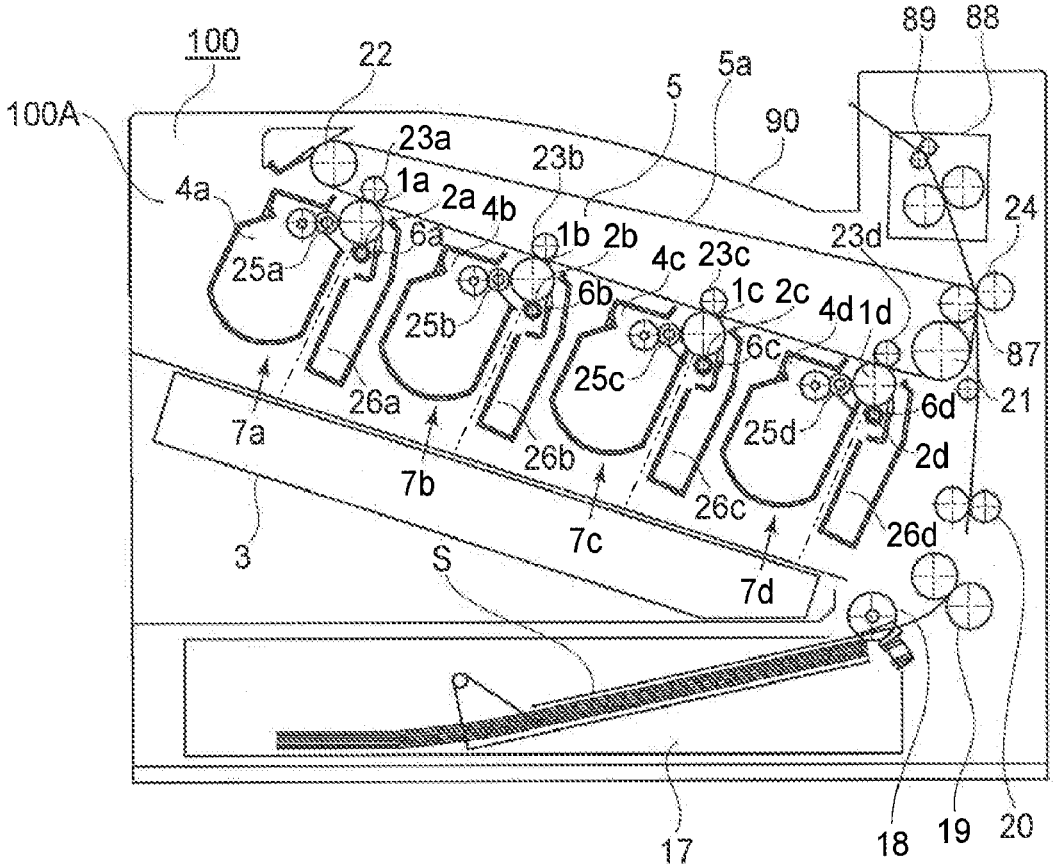
FIG. 1 is a general arrangement of a color electrophotographic image forming apparatus of an embodiment according to the present invention.

Referring to FIG. 1, the description will first be made as to a general arrangement of an image forming apparatus. In addition, FIG. 1 is a general arrangement of the image forming apparatus according to this embodiment.

Referring to FIG. 1, the description will first be made about the general arrangement of an electrophotographic image forming apparatus (the image forming apparatus) 100. As shown in FIG. 1 four detachably mountable process cartridges 7 (7*a*, 7*b*, 7*c*, 7*d*) are mounted to the rear side by a mounting member (an unshown) from the front side of the Figure. In FIG. 1, the process cartridge 7 is inclined and juxtaposed relative to a horizontal direction in the main assembly of the apparatus 100A.

In each process cartridge 7, there are provided an electrophotographic photosensitive drum (the photosensitive drum) 1 (1*a*, 1*b*, 1*c*, 1*d*), and a charging roller 2 (2*a*, 2*b*, 2*c*, 2*d*), a developing roller 25 (25*a*, 25*b*, 25*c*, 25*d*), and a process means, such as a cleaning member 6 (6*a*, 6*b*, 6*c*, 6*d*), which are integrally disposed around a photosensitive member drum 1. The charging roller 2 has the function of charging a surface of the photosensitive drum 1 uniformly, and the developing roller 25 has the function of developing and visualizes the latent image formed on the photosensitive drum 1 with a toner. The cleaning member 6 has the function of removing the developer which remains on the photosensitive drum 1, after transferring onto a recording material a developer image formed on the photosensitive drum 1.

A scanner unit 3 for effecting the selective exposure for the photosensitive drum 1 on the basis of the image information, thereby forming a latent image on the photosensitive drum 1 is provided below the process cartridge 7.

A cassette 17 which contains a recording material S in the lower part of an apparatus main assembly 100A is mounted. There is provided a recording material feeding means for an apparatus main assembly A to feed the recording material S upwardly. In more detail, there are provided a feeding roller 18 for carrying out the separation and feeding of the recording material S in the cassette 17 one by one, and a conveying roller pair 19 for feeding the fed recording material S and a resist roller pair 20 for providing the synchronism between the latent image and the recording material S formed on the photosensitive drum 1. An intermediary transfer unit 5 as an intermediary transfer means for transferring a toner image formed on a photosensitive drum 1 (1*a*, 1*b*, 1*c*, 1*d*) is provided above the process cartridge 7 (7*a*, 7*b*, 7*c*, 7*d*).

The intermediary transfer unit 5 includes a driving roller 21 and a follower roller 22, a primary transfer roller 23 provided in the position opposed to each photosensitive drum 1 (23*a*, 23*b*, 2*c*, 23*d*), a secondary transfer roller 24, an opposing roller 87 provided in the position. opposed to the secondary transfer roller 24, and an intermediary transfer belt extended around those rollers 5*a*. The intermediary transfer belt 5*a* is circulated so that all the photosensitive drums 1 may be opposed and contacted, and by applying the voltage to the primary transfer roller 23, it effects the primary transfer onto the intermediary transfer belt 5*c* from the photosensitive drum 1. By a voltage application between the opposing roller 87 disposed in the intermediary transfer belt 5*a*, and the secondary transfer roller 24, the toner is transferred onto the recording material S from the intermediary transfer belt 5*a*.

in the case of the image formation, each photosensitive drum 1 is rotated and the photosensitive drum 1 uniformly charged by the charging roller 2 is exposed to the selective by the scanner unit 3. By this, an electrostatic latent image is formed on the photosensitive drum 1. The latent image is developed with the developing roller 25. By this, a color developer image is formed on each photosensitive drum 1. In synchronism with this image formation, the resist roller pair 20 feeds the recording material S to a secondary transfer position where the opposing roller 87 and the secondary transfer roller 24 oppose to each other interposing therebetween the intermediary transfer belt 5*a*. By applying an image transfer bias voltage to the secondary transfer roller 24, each color developer image on the intermediary transfer belt 5*a* is transferred secondarily onto the recording material S. By doing so, a color image is formed on the recording material S. The recording material S having the color image is heated and pressed by a fixing portion 88, and the developer image is fixed. Thereafter, the recording material S is discharged to a discharging portion 90 by the discharging rollers 89. The fixing portion 88 is disposed at an upper portion of the apparatus main assembly 100A.

(Process Cartridge)

Figure 2:
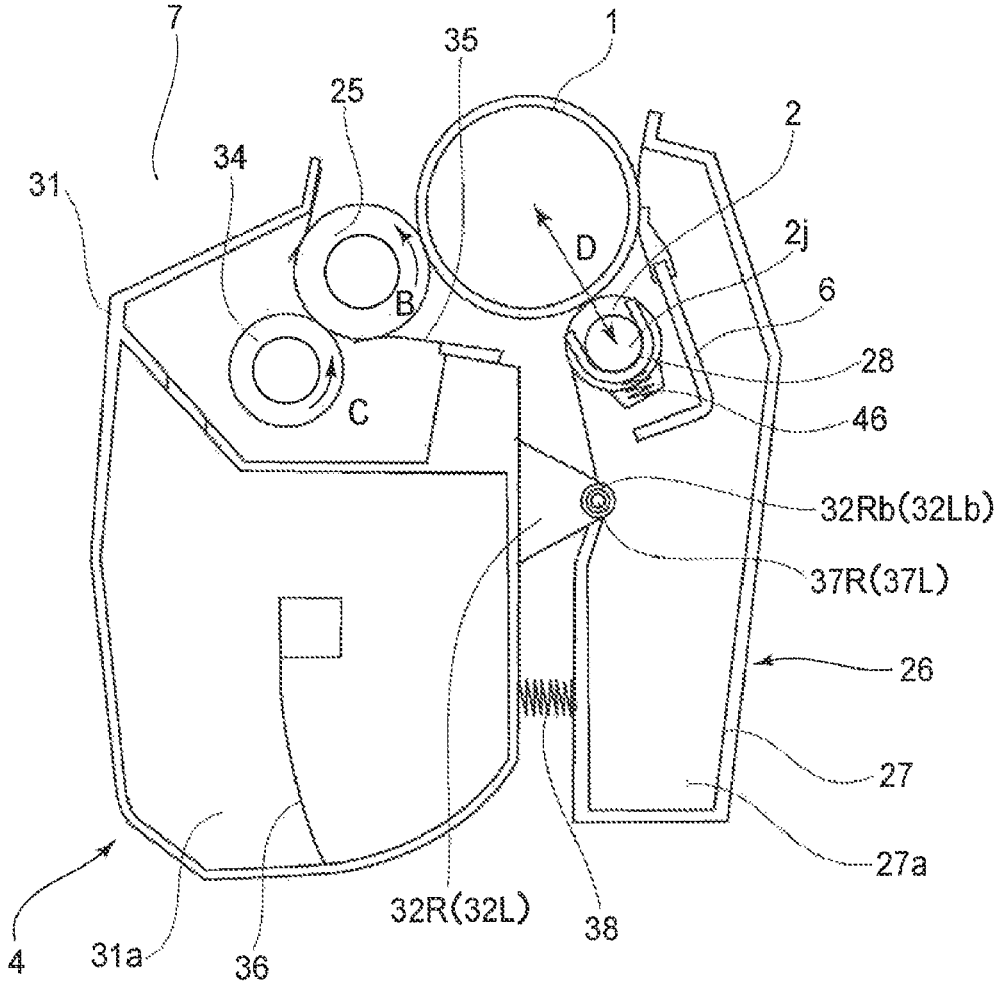
FIG. 2 is a cross-sectional illustration of a process cartridge.

Referring to FIG. 2, the process cartridge 7 according to this embodiment will be described. FIG. 2 shows a major section of the process cartridge 7 which contains a developer (the toner). A process cartridge 7*a* which contains the toner of a yellow color, a process cartridge 7*b* which contains the toner of a magenta color, a process cartridge 7*c* which contains the toner of a cyan color, and a process cartridge 7*d* which contains the toner of a black color, have the same structures.

The process cartridge 7 comprises a drum unit 26 (26*a*-26*d*) provided with photosensitive drum 1, charging roller 2, and cleaning member 6, and a developing unit 4 (4*a*-4*d*) which has a development member.

The photosensitive drum 1 is rotatably mounted through the bearing (unshown) in a cleaning frame 27 of the drum unit 26. The charging roller 2 and the cleaning member 6 are disposed around the photosensitive drum 1. The residual toner removed by the cleaning member 6 from a photosensitive drum 1 surface falls into a removed toner chamber 27*a*. By transmitting a driving force of a driving motor (unshown) which is a driving source to the drum unit 26, the photosensitive drum 1 is rotated correspondingly to an image forming operation. A charging roller bearing 28 is the movable in the direction of an arrow D relative to the cleaning frame 27. A shaft 2*j* of the charging roller 2 is rotatably mounted to charging roller bearings 28, and the charging roller bearing 28 is pressed by a charging roller pressing member 46 toward the photosensitive drum 1.

The developing unit 4 which is a developing device comprises, the developing roller 25 which is rotatable in the direction of an arrow B and which contacts with the photosensitive drum 1 and a developing device frame 31. The developing roller 25 is rotatably supported on the developing device frame 31 through the bearing members 32 (R "&", 32L) mounted to the ends of developing device frame 31. Around the developing roller 25 a toner supplying roller 34 rotated in the direction of an arrow C in contact with the developing roller 25 and a developing blade 35 for regulating a toner layer on the developing roller 25 are provided. A toner feeding member 36 for stirring the toner contained in a toner accommodating portion 31*a* of the developing device frame 31, and for feeding the toner to the toner supplying roller 34, is provided.

The developing unit 4 is connected with the drum unit 26 rotatable with the center thereof aligned with the shaft 37R, 37L engaged with a hole 32Rb, 32Lb of a bearing member 32R, 32L. During an image formation of the process cartridge 7 the developing unit 4 is urged by a pressing spring 38, it is rotated about the shafts 37R, 37L, and the developing roller 25 is in contact with the photosensitive drum 1.

(Mounting Mechanism to Main Assembly of Image Forming Apparatus of Process Cartridge)

Referring to FIG. 3, the mechanism for mounting the process cartridge 7 of the present invention to the apparatus main assembly 100A will be described.

FIG. 3*a* is an illustration of the state before the mounting, to the apparatus main assembly 100A, of the process cartridge 7. In FIG. 3*a*, the process cartridge 7 is entered in the direction of an arrow E through an opening 82*b* of a front side plate 82 of the apparatus main assembly 100A, and is mounted. Here, the direction of E is a longitudinal direction of the process cartridge 7. The longitudinal direction of the process cartridge 7 is an axial direction of the photosensitive drum 1, and is also the axial direction of the developing roller 25. At the time of a mounting operation, while a guide portion 27*b* provided integrally on the cleaning frame 27 of the process cartridge 7 is guided by the state where it is put on a guide portion 81*a* of a guiding member 81 provided in the main assembly of the apparatus 100A, it is mounted in the direction of the arrow E. The guiding member 81 is a mounting member for mounting the process cartridge 7 dismountably.

FIG. 3*b* is an illustration in the state where the process cartridge 7 is mounted to a rear side plate 83 in a mounting direction. When the process cartridge 7 is advanced in the direction of the arrow E, an abutting portion 27*c* provided integrally on the cleaning frame 27 contacts to the rear side plate 83 of the main assembly of the apparatus 100A, by which the things, the process cartridge 7 is inserted to the rear side plate 83. By this, the position with respect to the longitudinal direction of the process cartridge 7 becomes settled, but in this state, the process cartridge 7 is not completely positioned in the apparatus main assembly 100A. More particularly, in an up-down direction (the direction crossing with the longitudinal direction of the process cartridge 7), the process cartridge 7 is not positioned. The photosensitive drum 1 is not contacted to a transfer belt 5*a* of the intermediary transfer unit 5, either.

FIG. 3*c* is an illustration in the state where the process cartridge 7 is completely set to the apparatus main assembly 100A. After the process cartridge 7 is mounted to the rear side plate 83 in the longitudinal direction, the movable members 84R, 84L provided in the apparatus main assembly 100A press a portion-to-be-urged 27Ld, 27Rd provided integrally on the cleaning frame 27 in the direction of an arrow F. The movable member 84 R and 84 L is moved in interrelation with an opening-closing cover (unshown) provided in an apparatus main assembly 100 A. In mounting the process cartridge 7, the opening-closing cover (unshown) open and closes the opening (unshown) provided in the apparatus main assembly 100A. The positioning portions 27Re, 27Le provided integrally on the cleaning frame 27 contact to an abutting portion 82*a* of the front side plate 82 of the apparatus main assembly 100A; and to an abutting portion 83*a* of the rear side plate 83,. respectively, so that the process cartridge 7 is positioned with respect to the up-down direction. By this, the process cartridge 7 is completely positioned in the main assembly of the apparatus 100A. In addition, in this state, the photosensitive drum 1 and the transfer belt 5*a* are also contacted to each other.

In other words, the rear side plate 83 abutted by the abutting portion 27*c* is a positioning portion with respect to the longitudinal direction of the process cartridge 7. The abutting portions 82*a*, 83*a* abutted by the positioning portions 27Re, 27Le are main assembly positioning portions for positioning the process cartridge 7 in the up-down direction.

When the process cartridge 7 is entered into the inside of the apparatus main assembly 100A, a movable member 84R, 84L can take first positions (the position of FIG. 3*a*) which permit the entrance thereof. More particularly, in the first position, the movable members 84R, 84L take the position for not projecting from the guide 81*a* so that the entrance of the process cartridge 7 may not be prevented. At this time, the opening-closing cover (unshown) is in the position for opening the opening (unshown). The movable members 84R, 84L can take the second positions (the positions of FIG. 3*c*) for pressing the process cartridge 7 in the direction crossing with the longitudinal direction (entrance direction) of the process cartridge 7, in order to position the process cartridge 7 in the main assembly positioning portion. More particularly, the movable member 84R, 84L is in the position projected from the guide 81*a*. At this time, the opening-closing cover (unshown) is in the position for closing the opening (unshown). It moves to the position for closing from the position for the opening-closing cover (unshown) to release more particularly, so that the things, movable member 84R and 84L is moved to the second position from the first position. More particularly, when the process cartridge 7 shown in FIG. 3*a* is mounted in the longitudinal direction, it can mount, spacing the photosensitive drum 1 from the transfer belt 5*a*, and therefore, the photosensitive drum 1 and the transfer belt Sa do not rub with each other. The photosensitive drum 1 can be contacted to the transfer belt 5*a* by the movement, to the second position from the first position, of the movable member 84R, 84L.

(Supporting Structure of Developing Roller in Process Cartridge, and Oldham Coupling)

Referring to FIG. 4-FIG. 6, the structure and a supporting structure of the developing roller 25 using an Oldham coupling 48 as a shaft coupling member is in the acc process cartridge 7 according to this embodiment will be described. FIG. 4 shows one longitudinal end of a supporting portion of the developing roller 25. In FIG. 4, a developing roller shaft 25*j* of the developing roller 25 is in engagement rotatably with the inner surface of a bearing portion 32Lc provided integrally on a bearing member 32L. Between a rubber roller portion 25*g* of the developing roller 25, and the bearing portion 32Lc, a regulation roller 47 for regulating a degree of contact to the photosensitive drum 1 of the developing roller 25 is rotatably engaged with the developing roller shaft 25*j*. Although. the supporting structure of a one longitudinal one end of the developing roller 25 has been described so far, the bearing portion is integrally provided in the bearing member also to the other end, in the longitudinal direction, and it engages rotatably with the other end of a developing roller shaft.

Referring to FIGS. 5 and 6 the structure of the Oldham coupling 48 which is the shaft coupling member of this embodiment will be described. Here, in order to describe the structure of the Oldham coupling 48, the bearing member 32L is omitted.

In FIG. 5, the Oldham coupling 48 comprises a driven side engaging portion 48*a*, an intermediary engaging portion 48*b*, and a driving side engaging portion 48*c*. The driven side engaging portion 48*a* is fixed to the end of the developing roller shaft 25*j* here. As the fixed method, it is possible to connect then by spring pins or parallel pins. In FIG. 5, a cut portion 25*c* is provided in the end surface of the developing roller shaft 25*j*, and it is cut into the configuration corresponding to a hole of the driven side engaging portion 48*a*, and they are connected. The driving side engaging portion 48*c* is rotatably engaged with an engaging portion bearing member 49. The driving side engaging portion 48*c* which is an engaging portion is provided with the projections 48*c*1-48*c*4 engaged with the main assembly development coupling 53 (FIG. 7) which is a second main assembly driving force transmitting member of the apparatus main assembly 100A. The Oldham coupling 48 transmits a rotational driving force (a second rotational driving force) to the developing roller 25 from the main assembly of the apparatus 100A, permitting the deviation between the axis of a main assembly development coupling 53 and the axis of the developing roller 25.

Referring to FIG. 6, the structure of the Oldham coupling 48 will be described in more detail, FIG. 6*a* is a sectional view as seen in the direction of an arrow H of FIG. 5, and FIG. 6*b* is a sectional view as seen in the direction of an arrow G of FIG. 5.

In FIG. 6*a*, the driven side engaging portion 48*a* is provided with an integral rib 48*a*1. The intermediary engaging portion 48*b* is provided with a groove 48*ba*1, and the rib 48*a*1 and the groove 48*ba*1 are in engagement with each other for movement of the direction of the arrow G in FIG. 5.

In FIG. 6*b*, a rib 48*c*6 is integrally provided on the driving side engaging portion 48*c*. The intermediary engaging portion 48*b* is provided with a groove 48*bc*1, and the rib 48*c*6 and the groove 48*bc*1 are in engagement with each other for movement in the direction of the arrow H in FIG. 6.

FIG. 7*a* shows the structure of a coupling provided in the process cartridge 7. The end surface of the driving side engaging portion 48*c* of the Oldham coupling 43 provided in the developing unit 4 is provided integrally with the projections 48*c*1-48*c*3 projected toward the axial direction. A centering projection 48*c*4 which is an engaging portion positioning portion for aligning the main assembly 53 and the axis with each other projects, in the axial direction, from the end surface of the driving side engaging portion 48*c*. The free end of the photosensitive drum 1 is provided with a drum coupling 1*c* which has a triangular prism configuration. A guide portion 49*b* of the engaging portion bearing member 49 is guided, for movement in the direction crossing with the axial direction of the developing roller 25, in a groove 50*a* of a side cover 50 fixed to the developing unit 4 by unshown screws and so on. In other words, the driving side engaging portion 43*c* is movable in the direction crossing with an axis 25 of the developing roller 25.

FIG. 7*b* shows the structure of the coupling provided in the apparatus main assembly 100A. In FIG. 7*b*, a drum drive coupling 66 which is a first main assembly driving force transmitting member for transmitting the driving force to the photosensitive drum 1 from the apparatus main assembly 100A is provided with a hole 66*a* which has the section of a substantially triangular shape. After the process cartridge 7 is positioned in a main assembly positioning portion 82*a*, 83*a* by a movable member 84R, 84L, a coupling moving mechanism 66*b* moves in the direction of an arrow m. By this, the drum drive coupling 66 is moved together with the coupling moving mechanism 66*b* toward the process cartridge 7 in the direction of the axis of the photosensitive drum 1. When the phase of the hole 66*a* of the drum coupling l*c* and the drum drive coupling 66 does not align, an end surface 1*c*1 of the drum coupling 1*c* and an end surface 66*c* of the drum drive coupling 66 contact to each other. In that case, the drum drive coupling 66 is retracted in the direction of an arrow n against an urging force of a spring 66*b*1 provided in a movement plate 66*b*2. When the phases of the drum coupling 1*c* and the hole 66*a* align with each other by the rotation of the drum drive coupling 66, the drum drive coupling 66 is moved in the direction of an arrow r by the urging force of the spring 66*b*1, and the coupling 1*c* and the hole 66*a* are engaged with each other. The rotational driving force (a first rotational driving force) is transmitted to the photosensitive drum 1 by the drum drive coupling 66. The process cartridge 7 shown in FIG. 3*c* is positioned in the main assembly positioning portion 82*a*, 83*a* by the movable member 84R, 84L, by which the drum coupling 1*c* engages with the drum drive coupling 66. Therefore, the drum drive coupling 66 is retracted until the process cartridge 7 is positioned in the main assembly positioning portion 82*a*, 83*a*. Therefore, the above described coupling moving mechanism 66 is used.

On the other hand, the main assembly development coupling 53 is only urged toward the process cartridge 7 by pressing members 53*c*, such as a compression spring, in the direction parallel with the axis of the developing roller 25. The developing roller 25 is provided with the Oldham coupling 48. Therefore, as shown in FIG. 3*b*, before the process cartridge 7 is positioned in the main assembly positioning portion 82*a*, 83*a*, the main assembly development coupling 53 and the Oldham coupling 48 are engageable with each other. When the process cartridge 7 enters the apparatus main assembly 100A, the driving side engaging portion 48*c* may deviate from the axis of the developing roller 25, as long as it positions in the position for engagement with the main assembly development coupling 53. Therefore, a retraction mechanism in the main assembly development coupling 53 does not need to be a coupling moving mechanism which is used by the drum drive coupling 66, and therefore, a simple structure is satisfactory.

The detailed structure of the main assembly development coupling 53 will be described. The main assembly development coupling 53 is provided with the holes 53*b*1, 53*b*2, 53*b*3. The main assembly development coupling 53 is urged in the direction parallel with the axis of the developing roller 25 by the pressing members 53*c*, such as the compression spring, toward the process cartridge 7.

When the driving side engaging portion 48*c* and the main assembly development coupling 53 engage with each other at the time of the entrance into the apparatus main assembly 100A of the process cartridge 7, the phases may not align between the projections 48*c*1-48*c*3 and the holes 53*b*1-53*b*3 In such a case, the free end of a projection 48*c*1-48*c*3 contacts to portions other than a hole 53*b*1-53*b*3, and retracts in the axial direction against the urging force of the main assembly development coupling 53 and the pressing member 53*c*. However, when the phases of the projections 48*c*1-48*c*3 and the holes 53*b*1-53*b*3 align by the rotation of the main assembly development coupling 53, the main assembly development coupling 53 is advanced by the urging force of the pressing member 53*c*. Then, the projections 48*c*1-48*c*3 and the holes 53*b*1-53*b*3 engage with each other, and the centering boss 48*c*4 and the centering hole 53*b*4 which is a transmission member positioning portion engage with each other, so that the axis (a rotation axis) of the driving side engaging portion 48*c* and the main assembly development coupling 53 align with each other. When the phases align between the projections 48*c*1-48*c*3 and the holes 53*b*1-53*b*3, they engage with each other so that the rotational driving force is transmitted to the developing roller 25.

Here, the rotational driving forces to the drum drive coupling 66 and the main assembly development coupling 53 are supplied from a motor (unshown) provided in the apparatus main assembly 100A. It is the satisfactory using the one motor for all a process cartridges, or the one motor may cover all the process cartridges.

As has been described hereinbefore, the driving force is directly inputted to the developing roller 25 from the apparatus main assembly 100A independently of a driving input to the photosensitive drum 1. Therefore, a rotational accuracy of the photosensitive drum 1 is free from the influence of the rotation of the developing roller 25, and, furthermore, the rotational accuracy of a developing roller 25 per se is improved, and therefore, an image quality can be improved.

(Operation of Oldham Coupling at the Time of Process Cartridge Mounting to Main Assembly of Image Forming Apparatus)

Referring to FIG. 8-FIG. 10, the operation of the Oldham coupling 48 at the time of the mounting to a main assembly of the image forming apparatus 100A in the process cartridge 7 of the present invention will be described. FIG. 8*a* is a view, as seen from a downstream side (with respect to mounting direction), of the process cartridge 7 (FIG. 3*a*) mounted toward the rear side plate 83. FIG. 8*b* is a sectional view as seen from a longitudinal end surface (the arrow V1).

As shown in FIG. 8*b*, an axis 53*a* of the main assembly development coupling 53 of the apparatus main assembly 100A deviates from an axis 25*k* of the developing roller 25 of the process cartridge 7. In more detail, when the process cartridge 7 enters the apparatus main assembly 100A, the photosensitive drum 1 and the developing roller 25 can be lowered so that the photosensitive drum 1 and the transfer belt 5*a* may not rub. The main assembly development coupling 53 is provided, so that when the process cartridge 7 is positioned in the main assembly positioning portion 82*a*, 83*a*, the axis 25*k* of the developing roller 25 and the axis 53*a* substantially align with each other. The driving side engaging portion 48*c* is urged by a urging member 54 through the engaging portion bearing member 49, and is positioned in a holding portion 27*f* provided in the cleaning frame 27. By this, an axis 48*c*5 of the driving side engaging portion 48*c* is disposed at the position substantially aligned with the axis 53*a*, so that when the process cartridge 7 is set, the driving side engaging portion 48*c* engages with the main assembly development coupling 53 easily. More particularly, the driving side engaging portion 46*c* is positioned in the holding portion 27*f*, so that when the process cartridge 7 enters in the apparatus main assembly 100A, the axis 48*c*5 is in the position near the axis 53*a* of the main assembly development coupling 53 than the axis 25*k*.

The distance between the axis 48*c*5 and the axis 25*k* of the developing roller 25 here is D1. It is not necessary to provide a large guide of a for the engagement in the engaging portion 48*c* and the main assembly development coupling 53 by therefore, positioning an engaging portion 48*c* in the holding portion 27*f*, and therefore, a downsizing of the process cartridge 7 and an electrophotographic image forming apparatus 100 can be accomplished. The urging member 54 is used in order to urge the engaging portion bearing member 49. However, by mounting an elastically deformable elastic portion integrally on the engaging portion bearing member 49, the engaging portion bearing member 49 may be contacted to the holding portion 27*f*.

FIG. 9*a* is a view, as seen from the downstream side (with respect to mounting direction), of the process cartridge 7 (FIG. 3*b*) mounted to the rear side plate 83 of the apparatus main assembly 100A. FIG. 9*b* is a sectional view as seen from a longitudinal end surface (an arrow V2).

As shown in FIG. 9*a*, when the process cartridge 7 is mounted to the rear side plate 83, while being guided on the guiding member 81 of the apparatus main assembly 100A, the process cartridge 7 is not pressed by the movable member 84 yet. For this reason, the process cartridge 7 is not completely positioned in the apparatus main assembly 100A, but the photosensitive drum 1 spaces from the transfer belt 5*a*.

As shown in FIG. 9*b*, when the phases of the projections 48*c*1-48*c*3 and the holes 53*b*1-53*b*3 in this state, do not align relative to each other, a contact portion 49*b* is contacted and positioned in a main assembly locking member 85 provided in the main assembly of the apparatus 100A in place of the holding portion 27*f*. When the contact portion 49*b* is positioned by the main assembly locking member 85, it is guided by an inclined surface 85*a* provided at the free end of the main assembly locking member 85 FIG. 9*b*. Therefore, a gap is provided between the contact portion 49*b* and the holding portion 27*f*. Here, the driving side engaging portion 48*c* is in engagement with the engaging portion bearing member 49 rotatably. Therefore, the driving side engaging portion 48*c* is positioned in the main assembly locking member 85 through the engaging portion bearing member 49. Therefore, a distance D2 between the axis 48*c*5 and the axis 25*k* of the developing roller 25 here is smaller than above described D1. The main assembly development coupling 53 is pushed by the projections 48*c*1-48*c*3 of the driving side engaging portion 48*c* to retract in the direction (the axial direction) of an arrow J in the Figure.

As shown in FIG. 9*c*, after inserting to the rear side plate 83 (FIG. 3) of the process cartridge 7, in the case where the phases of the projections 48*c*1-48*c*3 and the holes 53*b*1-53*b*3 align with each other, the projections 48*c*4 and the holes 53*b*4 engage with each other, so that, the driving side engaging portion 48*c* is positioned. In that case, the contact portion 49*b* of the engaging portion bearing member 49 and the main assembly locking member 85 are spaced from each other. Therefore, the distance D3 between the axis 48*c*5 and the axis 25*k* of the developing roller 25 here is smaller than the above described distances D1 and D2.

FIG. 10*a* is the Figure as seen from the downstream side (with respect to mounting direction) of the process cartridge 7 positioned in the main assembly positioning portion 82*a*, 83*a* by the pressing by the movable member 84R, 84L (FIG. 3*c*). FIG. 10*b* is a section view as seen from the side surface (an arrow V3) in the longitudinal direction about FIG. 10*a*.

As shown in FIG. 10*a*, the cleaning frame 27 of the process cartridge 7 receives a force from the movable member 84, so that it is urged in the direction of an arrow. By this, a cartridge positioning portion 27*g*1 contacts to the abutting portion 83*a* of a rear side plate of the main assembly of the apparatus 100A, so that the process cartridge 7 is completely positioned in the main assembly of the apparatus 100A, and contacts the photosensitive drum 1 and the transfer belt 5*a* with each other. The axis 25*k* of the developing roller 25 is substantially aligned with the axis 53*a* of the main assembly development coupling 53. Here, the cartridge positioning portion 27*g*1 is a part of a drum bearing 27*g* which supports the photosensitive drum 1 rotatably provided in the cleaning frame 27 The contact portion 49*b* of the engaging portion bearing member 49 is contacted and stopped by the main assembly locking member 85, or the projection of (FIG. 10*b*) and the driving side engaging portion 48*c* 48*c*4.

The hole 53*b*4 of the main assembly development coupling 53 engages, and the driving side engaging portion 48*c* is positioned (FIG. 10*c*). I For this reason, even if the process cartridge 7 moves in the direction of the arrow, the driving side engaging portion 48*c* regulates in the movement, and therefore, it is not moved together with the process cartridge 7. Therefore, in a movement direction (the direction of the arrow) of the process cartridge 7, to position the main assembly locking member 85 at a downstream of the main assembly development coupling 53. Therefore, the distances D4 (FIG. 10*b*) between the axis 48*c*5 and the axis 25*k* of the developing roller 25 and the distance (D5 FIG. 10*c*) are smaller above described D1, D2, D3.

As shown in FIG. 10*b*, when the phases of the projections 48*c*1-48*c*3 and the holes 53*b*1-53*b*3 do not align with each other the projections 48*c*1-48*c*3 align with the holes 53*b*1-53*b*3 in the phase by the rotation of the main assembly development coupling 53. And, the driving side engaging portion 48*c* and the main assembly development coupling 53 engage with each other. As shown in FIG. 10*c*, on the other hand, if the holes 53*b*1-53*b*3 and the phases by which the projections 48*c*1-48*c*3 of the driving side engaging portion 48*c* are provided in the main assembly development coupling 53 align with each other, the driving side engaging portion 48*c* and the main assembly development coupling 53 are in engagement with each other. The rotational driving force (second rotational driving force) is transmitted to the driving side engaging portion 48*c* by the rotation of the main assembly development coupling 53.

As has been described hereinbefore, in the structure for positioning in the main assembly positioning portions 82*a*, 83*a* by in movable members 84R, 84L in the direction crossing with the entrance direction of the process cartridge 7, the retraction mechanism for the main assembly development coupling 53 can be simplified, and therefore, the image forming apparatus 100 can be downsized.

By positioning the driving side engaging portion 48*c* provided in the Oldham coupling 48 in the holding portion 27*f*, there is no need of providing the large guide for the engagement in the driving side engaging portion 48*c* and the main assembly development coupling 53. Therefore, the downsizing of the process cartridge 7 and the electrophotographic image forming apparatus 100 can be accomplished.

Although the example which uses the Oldham coupling 48 has been described in this embodiment, it is the satisfactory also using another coupling (for example, lateral coupling) and so on which has the effect of absorbing a rotational variation produced when an input portion and an output axis (rotation axis) are deviated from each other.

Second Embodiment:

In a cartridge according to a second embodiment, the description will be made, referring to FIGS. 15-11, about the operation of an Oldham coupling at the time of the mounting to a main assembly of the image forming apparatus. In the description of this embodiment, the same reference numerals as in the foregoing Embodiments are assigned to the elements having the corresponding functions in this embodiment, and the detailed description thereof is omitted for simplicity.

FIG. 11*a* is a view, as seen from the downstream side (with respect to mounting direction), of the process cartridge 7 (FIG. 3*a*) mounted toward the rear side plate 83, and FIG. 11*b* is a sectional view as seen from the longitudinal end surface (an arrow V4).

As shown in FIG. 11*a* and FIG. *b*, in the state in the course of the process cartridge 7 being guided and mounted to the guiding member 81 of the apparatus main assembly 100A it is not pressed by the movable member 84. For this reason, it is not completely positioned in the apparatus main assembly 100A. The developing unit 4 is provided with a spacing holding member 86 for retaining the developing unit 4 in a spaced position for spacing the developing roller 25 relative to the photosensitive drum 1 in the state of a process cartridge 7 alone. Similarly to the first embodiment, the developing unit 4 is urged in the direction with which the developing roller 25 contacts to the photosensitive drum 1 with the center thereof aligned with the shaft 37 by a pressing spring (unshown). However, the spacing holding member 86 is in engagement a hole 27*e* provided in the side surface of the cleaning frame 27, and therefore, the developing unit 4 is rotated in the direction of an arrow L with the center thereof aligned with the shaft 37, so that it is retained in the spaced position. The position of the spacing holding member 86 at this time is an engagement position.

However, the engaging portion bearing member 49 is urged in the direction (the direction of arrow I in is the Figure) crossing with the axis 25*k* of the developing roller 25 by the urging member 54. Therefore, the contact portion 49*b* of the engaging portion bearing member 49 is contacted to the holding portion 27*f* provided in the cleaning frame 27 of the process cartridge 7, so that the position of the engaging portion bearing member 49 is determined. The axis (the rotation axis) 48*c*5 of the driving side engaging portion 48*c* and the axis 25*k* of a developing roller are deviated from each other. In view of this, similarly to the first embodiment the photosensitive drum 1 and the developing roller 25 are lowered so that the photosensitive drum 1 and the transfer belt 5*a* may not rub with each other at the time of the entrance into the apparatus main assembly 100A of the process cartridge 7. For this reason, similarly to the first embodiment, the main assembly development coupling 53 is provided, so that at the time of the positioning of the process cartridge 7 relative to the main assembly positioning portion 82*a*, 83*a*, the axis 25*k* of the developing roller 25 and the axis 53*a* substantially align with each other.

The holding portion 27*f* is provided on the cleaning frame 27 on which the photosensitive drum 1 is mounted, and the contact portion 49*b* contacts to this holding portion 27*f* for the positioning. For this reason, the engaging portion bearing member 49 is positioned with the high position accuracy relative to the photosensitive drum 1 mounted with the high position accuracy relative to the apparatus main assembly 100A. More particularly, if the process cartridge 7 is in this state, further entered as shown in FIG. 11*b*, an axis 48*b*5 of the driving side engaging portion 48*c* is disposed at the axis 53*a* and the substantial position to conform so that it is easy to engage the driving side engaging portion 48*c* with the main assembly development coupling 53. More particularly, the driving side engaging portion 48*c* is positioned on the holding portion 27*f*, so that in the case of the entrance into the inside of the apparatus main assembly 100A of the process cartridge 7, the axis 48*c*5 is closer to the axis 53*a* of the main assembly development coupling 53 than the axis 25*k*. Here, the distance between the axis 48*c*5 and the axis 25*k* of the developing roller 25 is S1. The engaging portion 48*c* is positioned in the holding portion 27*f*, and therefore, it is not necessary to provide the large guide for the engagement in the engaging portion 48*c* and the main assembly development coupling 53, and the downsizing of the process cartridge 7 and the electrophotographic image forming apparatus 100 can be accomplished.

FIG. 12*a* shows a view, as seen from the downstream side (with respect to mounting direction), of the process cartridge 7 (FIG. 3*b*) mounted until it ran against the rear side plate 83. FIG. 12*b* is a sectional view as seen from the longitudinal end surface (an arrow V5).

It is not pressed by the movable member 84 in the state shown in FIGS. 12*a* and 12*b*. For this reason, the process cartridge 7 is not positioned in the main assembly positioning portion 82*a*, 83*a* of the main assembly of the apparatus 100A, and therefore, the photosensitive drum 1 is in the state that it spaced from the transfer belt 5*a* At this time, the axis 53*a* of the main assembly development coupling 53 and the axis 25*k* of the developing roller 25 are deviated from each other.

As shown in FIG. 12*b*, when the phases of the projections 48*c*1-48*c*3 and the holes 53*b*1-53*b*3 do not, in this state, align with each other, the contact portion 49*b* is contacted and positioned in the main assembly locking member 85 in place of the holding portion 27*f*. At the time of the contact portion 49*b* being positioned by the main assembly locking member 85, it is guided by the inclined surface 85*a* provided at the free end of the main assembly locking member 85 FIG. 11*b*. Therefore, the contact portion 49*b* is spaced from the holding portion 27*f*. The driving side engaging portion 48*c* of the Oldham coupling 48 is in engagement the engaging portion bearing member 49 is rotatably here. Accordingly, the driving side engaging portion 48*c* is positioned in the main assembly locking member 85 through the engaging portion bearing member 49. Therefore, the distance between the axis 48*e*5 and the axis 25*k* of the developing roller 25 here is smaller than above described S2 S1. The main assembly development coupling 53 is pushed to the projections 48*c*1-48*c*3 of the driving side engaging portion 48*c*, and is retracted in the direction (the axial direction) of the arrow J in the Figure.

In the state where the process cartridge 7 has been set even to a backside version 83 (FIG. 3), in the case where the phases of the projections 48*c*1-48*c*3 and the holes 53*b*1-53*b*3 align with each other, the situation is the same as the case of FIG. 9*c*, and therefore, the detailed description is omitted here.

As shown in FIG. 12*b*, a main assembly releasing member 87 contacted with the spacing holding member 86 when the process cartridge 7 mounts to the apparatus main assembly 100A in the longitudinal direction, is provided in the apparatus main assembly 100A. Before the mounted process cartridge 7 is positioned in a main assembly positioning portion 82*b*, 83*a*, the main assembly releasing member 87 contacts with the spacing holding member 86, so that the engagement between the spacing holding member 86 and the hole 27*e* is released. The position of the spacing is holding member at this time 86 is a releasing position. When the spacing holding member 86 is released, the developing unit 4 moves to a contact position, so that the developing roller 25 can contact to the photosensitive drum 1. However, in the state where the process cartridge 7 is usually set to the apparatus main assembly 100A, a spacing mechanism 91 provided in the apparatus main assembly 100A contacts to a force receiving portion 31*b* of the developing device frame 31. Therefore, even if the spacing holding member 86 is released after the process cartridge 7 is mounted to the apparatus main assembly 100A, the developing roller 25 is not contacted to the photosensitive drum 1.

FIG. 13*a* is a view, as seen from the downstream side (with respect to mounting direction), of the process cartridge 7 positioned in the main assembly positioning portion 82*a*, 83*a* of the apparatus main assembly 100A by the movable member 84. FIG. 13*b* is a sectional view as seen from the longitudinal end surface (an arrow V6).

As shown in FIG. 13*a*, the cleaning frame 27 to of the process cartridge 7 receives the force from the movable member 84, and is urged in the direction of arrow I. By this, the cartridge positioning portion 27*g*1 contacts to the abutting portion 83*a* of the rear side plate of the apparatus main assembly 100A, so that the process cartridge 7 is positioned in the apparatus main assembly 100A, and the photosensitive drum 1 and the transfer belt 5*a* are contacted to each other. Here, the cartridge positioning portion 27*g*1 is a part of drum bearing 27*g*, for rotatably supporting the photosensitive drum 1, provided in the cleaning frame 27, The contact portion 49*b* of the engaging portion bearing member 49 is contacted and locked by the main assembly locking member 85, or the driving side engaging portion 48*c* is positioned by the engagement between the projection 48*c*4 provided in the driving side engaging portion 48*c*, and the hole 53*b*4 provided in the main assembly development coupling 53. I For this reason, even if the process cartridge 7 moves in the direction of the arrow, the driving side engaging portion 48*c* is retained in the position of FIG. 12, and it does not move together with the process cartridge 7. I Therefore, the main assembly locking member 85 is positioned downstream of the main assembly development coupling 53 with respect to the movement direction (the direction of an arrow) of the process cartridge 7. Here . . . S3 is smaller than above described S1 and S2 in the distance between axis 48*c*5 and axis 25*k* of the developing roller 25.

The force receiving portion 31*b* provided in the developing unit 4 continues receiving the force in the direction of an arrow N from the spacing mechanism 9, and therefore, the developing unit 4 is maintained at the spaced position by which the developing roller 25 is spaced from the photosensitive drum 1.

FIG. 14*a* is a view, as seen from the downstream side (with respect to mounting direction), of the cartridge which moves to the contact position where the developing roller 25 contacts to the photosensitive drum 1 by the rotation of the developing unit 4 by the operation of spacing mechanism 91. FIG. 14*b* is a sectional view as seen from the longitudinal end surface (an arrow V7).

As shown in FIG. 14*a*, the spacing mechanism 91 moves in the direction of an arrow P, and spaces from the force receiving portion 31*b* of the developing unit 4, and therefore, the developing unit 4 is rotated in the direction of an arrow Q about the shaft 37 according to the force of a pressing spring 3 FIG. 2). As shown in FIG. 14*b*, the developing unit 4 moves to the contact position where the photosensitive drum 1 and the developing roller 25 contact to each other. The axis 25*k* of the developing roller 25 is also substantially aligned with the axis 53*a* Of the main assembly development coupling 53. The distance 54 between the axis 48*c*5 and the axis 25*k* of the developing roller 25 here is smaller than above described S1, S2, and S3.

FIG. 15*a* is a view as seen from the downstream side (with respect to mounting direction) of the process cartridge 7 in the time of the image formation. FIG. 15*b* is a sectional view as seen from the end surface (an arrow V8) in the longitudinal direction.

Here, when the phases of the projections 48*c*1-48*c*3 and the holes 53*b*1-53*b*3 do not align with each other, the projections 48*c*1-48*c*3 align in the phases with the holes 53*b*1-53*b*3 by the rotation of the main assembly development coupling 53. Therefore, the main assembly development coupling 53 and the driving side engaging portion 48*c* engage with each other, and the rotational driving force (second rotational driving force) of the apparatus main assembly 100A is transmitted to the developing roller 25. In this state, the projection 48*c*5 provided integrally on the driving side engaging portion 48*c* and the hole 53*b*4 provided in the main assembly development coupling 53 engage with each other, and therefore, the axis 53*a* of the main assembly development coupling 53 and the axis (the rotation axis) 48*c*5 of the driving side engaging portion 48*c* align with each other. Similarly, the axis (the rotation axis) 25*k* of the developing roller 25 substantially aligns with the axis 53*a*. The contact portion 49*b* of the engaging portion bearing member 49 is spaced from a main assembly locking portion 85.

As has been described hereinbefore, in this embodiment, in addition to the effects of the first embodiment, even if it mounts the process cartridge 7 with the state where the photosensitive drum and the developing roller 25 spaced from each other, the engaging portion 48*c* and the main assembly development coupling 53 of a shaft coupling member 48 engage smoothly with each other, and therefore, a mounting property is improved.

Third Embodiment:

(Spacing Mechanism At The Time of Remounting Process Cartridge)

A spacing mechanism for mounting again the process cartridge 7 once removed from the apparatus main assembly 100A to the apparatus main assembly 100A will be described. In the description of this embodiment, the same reference numerals as in the foregoing embodiments are assigned to the elements having the corresponding functions in this embodiment, and the detailed description thereof is omitted for simplicity.

As shown in FIG. 14 and FIG. 15, the spacing holding member 86 is released from the hole 27*e* of the cleaning frame 27 in the process cartridge 7 taken out from the main assembly of the apparatus 100A. Therefore, the developing unit 4 is in the contact position and the photosensitive drum I and the developing roller 25 are in contact with each other. When the process cartridge 7 is demounted from the main assembly of the apparatus 100A, the image forming operation of the electrophotographic image forming apparatus 100 finishes. As shown in FIG. 13, in order to move the developing unit 4 to the spaced position, the spacing mechanism 91 contacts it to a spacing force receiving portion 31*b*. With this state of the spacing mechanism 91, the process cartridge 7 is demounted from the main assembly of the apparatus 100A, and the developing unit 4 returns to the contact position. However, when the process cartridge 7 is again mounted to the apparatus main assembly 100A, the spacing force receiving portion 31*b* of the developing unit 4 positioned at the contact position abuts to the side surface of the spacing mechanism 91, and therefore, the process cartridge 7 cannot be mounted to the apparatus main assembly 100A. In order to prevent this, when the removed process cartridge 7 is remounted, the developing unit 4 is made to move to the spaced position beforehand Referring to FIG. 16-FIG. 19, the structure for this will be described. As shown in FIG. 16 and FIG. 17, the apparatus main assembly 100A is provided with a mounting opening 87 for mounting the process cartridge 7. The apparatus main assembly 100A is provided with a spacing guide portion 92 which can be contacted to a projection 31*d* provided integrally with the spacing force receiving portion 31*b* provided in the developing unit 4 of the process cartridge 7.

As shown in FIG. 18*a*, before the process cartridge 7 enters the apparatus main assembly 100A, the developing unit 4 is in the contact position, and therefore, the photosensitive drum 1 and the developing roller 25 are in contact to each other. As shown in FIG. 18*b*, when the process cartridge 7 is mounted to the apparatus main assembly 100A, a guide portion 27*b* provided integrally on the cleaning frame 27 is first guided to a main assembly guide member 81 provided in the apparatus main assembly 100A. The projection 31*d* provided in the developing device frame 31 contacts to a beveled portion 92*a* of the spacing guide portion 92. As shown in FIG. 18*c*, when the process cartridge 7 is entered further, the developing unit 4 rotates in the direction of the arrow J about a back bearing member 15. Then, the developing unit 4 moves to the spaced position (arrow K), and the developing roller 25 spaces with the photosensitive drum 1 As shown in FIG. 19, when the process cartridge 7 is positioned in a main assembly of the image forming apparatus 100, the spacing force receiving portion 31*b* is contacted to the spacing mechanism 91 disposed at a mounting direction downstream of the spacing guide portion 92. In that case, the developing unit 4 is in the spaced position, and while the developing roller 25 is kept spaced from the photosensitive drum 1, the process cartridge 7 can be mounted to the main assembly of the image forming apparatus 100. In this case, a force clearance 31*e* provided in a mounting direction upstream of the process cartridge 7 of the force receiving portion 31*b* has the configuration for not interfering with a mounting guide portion 84. By this, the developing unit 4 can move to the contact position, without interfering with a spacing guide portion 84.

As has been described hereinbefore, also in this embodiment, the effects similar to the second embodiment are provided.

In addition to the effect in the first embodiment, even if it mounts the process cartridge 7 in the state where the photosensitive drum 1 and the developing roller 25 spaces from each other, the driving side engaging portion 48*c* and the main assembly development coupling 53 engage with each other smoothly, and therefore, the mounting property is improved.

Fourth Embodiment:

In the above described embodiment, the process cartridge 7 is mounted to the apparatus main assembly 100A. However, the present invention is preferably applicable, also when only the developing device is detachably mountable to the apparatus main assembly 100A.

Referring to FIG. 22 from FIG. 20, the operation of the Oldham coupling at the time of mounting a developing device 4 to the apparatus main assembly 100A will be described as a fourth embodiment. In the description of this embodiment, the same reference numerals as in the foregoing Embodiments are assigned to the elements having the corresponding functions in this embodiment, and the detailed description thereof is omitted for simplicity.

FIG. 20*a* shows the state before mounting the developing device 4 to the apparatus main assembly 100A in the longitudinal direction of the developing device 4. FIG. 20*b* shows the section as seen from the side surface (an arrow V9) in the longitudinal direction.

In FIG. 20*a* and FIG. 20*b*, the driving side engaging portion 48*c* is urged by the urging member 54 through the engaging portion bearing member 49. The driving side engaging portion 48*c* is positioned in a holding portion 31*f* provided in the developing device frame 31 through the engaging portion bearing member 49. Therefore, similarly to the case shown in the first embodiment, also before the developing device 4 is positioned, the Oldham coupling 48 is in the engageable position with the main assembly development coupling 53. By this, the developing roller 25 has lowered so that the rubbing between the developing roller 25 and the photosensitive drum 1 is prevented at the time of an entrance to the apparatus main assembly 100A of the developing device 4. More particularly, when the developing device 4 enters in the apparatus main assembly 100A, the driving side engaging portion 48*c* is positioned in the holding portion 31*f*, so that the axis 48*c*5 is in the position nearer the axis 53*a* of the main assembly development coupling 53 than the axis 25*k*. By positioning the engaging portion 48*c* in the holding portion 31*f*, it is not necessary to provide the large guide for the engagement in the engaging portion 48*c* and the main assembly development coupling 53, and therefore, the downsizing of the developing device 4 and the electrophotographic image forming apparatus 100 is accomplished, and it gets. The distance between the axis 48*c*5 and the axis 25*k* of the developing roller 25 here is L1.

FIG. 21*a* is an illustration showing the is developing device 4 set to the rear side plate (unshown) of the apparatus main assembly 100A. FIG. 21*b* is a sectional view as seen from the longitudinal end surface (an arrow V10).

As shown in FIG. 21*a*, after the developing device 4 is guided to the guiding member 81 of the apparatus main assembly 100A, it mounts to the rear side plate (unshown), and in this state, it is not pressed by the movable member 84 of the apparatus main assembly 100A. Therefore, the developing roller 25 spaces from the photosensitive drum 1.

As shown in FIG. 21*b*, when the phases of the projections 48*c*1-48*c*3 and the holes 53*b*1-53*b*3 are not aligned each other, in this state, the contact portion 49*h* is contacted and positioned to the main assembly locking member 85 provided in the apparatus main assembly 100A in place of the holding portion 31*f*. When the contact portion 49*b* is positioned by the main assembly locking member 85, it is guided into the state shown in FIG. 21*b* by the inclined surface 85*a* provided at the free end of the main assembly locking member 85. Here, the driving side engaging portion 48*c* of the Oldham coupling rotatably engages with the engaging portion bearing member 49. Therefore, the driving side engaging portion 48*c* is positioned in the main assembly locking member 85 through the engaging portion bearing member 49. Therefore, a distance L2 between the axis 48*c*5 and the axis 25*k* of the developing roller 25 here is smaller than above described L1. The main assembly development coupling 53 is pushed on the driving side engaging portion 48*c*, and is retracted in the direction (the axial direction) of the arrow J in the Figure.

When the phases of the projections 48*c*1-48*c*3 and a holes 53*b*1-53*b*3 align with each other, the projection 48*c*4 provided in the driving side engaging portion 48*c* and the hole 53*b*4 provided in the main assembly development coupling 53 engage with each other, and the driving side engaging portion 48*c* is positioned. In that case, the contact portion 49*b* and the main assembly locking member 85 of the engaging portion bearing member 49 space from each other.

FIG. 22*a* shows a view which shows the state where the developing device is positioned in the apparatus main assembly 100A by the movable member 84. FIG. 22*b* shows a view of the state as seen from the longitudinal end surface (an arrow V11).

As shown in FIG. 22*a*, by the developing device frame 31 of the developing device 4 receiving the force and being urged in the direction of the arrow from the movable member 84, regulation rollers 47 provided at the ends of the developing roller 25 contact to the photosensitive drum 1. The developing device 4 is completely positioned in the apparatus main assembly 100A, and the developing roller 25 and the photosensitive drum 1 are contacted to each other. And, the axis 25*k* of the developing roller 25 is substantially aligned with the axis 53*a* of the main assembly development coupling 53. Here, when the developing device moves in the direction of the arrow, the contact portion 49*b* of the engaging portion bearing member 49 is contacted and locked by the main assembly locking member 85, or the projection 48*c*4 and the hole 53*b*4 engage, and the driving side engaging portion 48*c* is positioned in the main assembly development coupling 53. For this reason, even if the developing device 4 moves in the direction of the arrow, the driving side engaging portion 48*c* is retained in the position of FIG. 21, and it does not move together with the developing device 4. Therefore, the developing device 4 positions the main assembly locking member 85 at the downstream of the main assembly development coupling 53 with respect to the movement direction of the movable member 84. Therefore, the distance L3 between the axis 48*c*5 and the axis 25*k* of the developing roller 25 is smaller than above described L1 and L2 here.

Here, when the phases of the projections 48*c*1-48*c*3 and the holes 53*b*1-53*b*3 do not match, the projections 48*c*1-48*c*3 of the coupling and the phases of the holes 53*b*1-53*b*3 match relative to each other, as shown in FIG. 22*b* by the rotation of the main assembly development coupling 53. Then, the driving side engaging portion 48*c* and the main assembly development coupling 53 engage. On the other hand, if the projections 48*c*1-48*c*3 of the driving side engaging portion 48*c* align with the holes 53*b*1-53*b*3 provided in the main assembly development coupling 53 in the phases, the driving side engaging portion 48*c* and the main assembly development coupling 53 are in engagement with each other. The rotational driving force is transmitted by the rotation of the main assembly development coupling 53.

As has been described hereinbefore, in the structure for positioning in the main assembly positioning portion 82*a*, 83*a* by the movable members 84R, 84L in the direction crossing with the entrance direction of the developing device 4, the retraction mechanism of the main assembly development coupling 53 can be simplified, and the electrophotographic image forming apparatus 100 can be downsized.

The engaging portion 48*c* provided in the shaft coupling member 48 is positioned in the holding portion 31*f*, and therefore, it is not necessary to provide the large guide for the engagement in the engaging portion 48*c* and the main assembly development coupling 53, and the downsizing of the developing device 4 and the electrophotographic image forming apparatus 100 can be accomplished.

In this embodiments, the description is made about the examples which use the Oldham coupling, it is the satisfactory also using another coupling (for example, lateral coupling) and so on which has the effect of absorbing the rotational variation produced when the axis (the rotation axes) of the input portion and the outputting part deviate from each other.

As has been described hereinbefore, according to the present invention, the retraction mechanism of the main assembly driving force transmitting member for transmitting the driving force to the developing roller can be simplified.

It is not necessary to provide the large guide for the engagement in the engaging portion and the main assembly driving force transmitting member, and the downsizing of the process cartridge and the electrophotographic image forming apparatus can be accomplished by positioning, to the holding portion, the engaging portion provided in the shaft coupling member.

Furthermore, the rotational accuracy of the developing roller can be improved, and therefore, the image quality can be improved.

While the invention has been described with reference to the structures disclosed herein, it is not confined to the details set forth, and this application is intended to cover such modification or changes as may come within the purposes of the improvements or the scope of the following claims.

This application claims priority from Japanese Patent Applications Nos. 332790/2006 and 297474/2007 filed Dec. 11, 2006 and Nov. 16, 2007 which are hereby incorporated by reference.

What is claimed is:

1. A process cartridge detachably mountable to a main assembly of an electrophotographic image forming apparatus that includes a drum coupling member, a development coupling member, and an abutting member, said process cartridge comprising:

(i) a photosensitive drum;

(ii) a drum coupling portion provided adjacent to one axial end of said photosensitive drum, said drum coupling portion being configured and positioned to engage with the drum coupling member to receive a driving force for rotating said photosensitive drum;

(iii) a developing roller configured and positioned (a) to develop an electrostatic latent image formed on said photosensitive drum, and (b) to be rotatable about an axis thereof;

(iv) a development coupling portion provided adjacent to one axial end of said developing roller, said development coupling portion including:

an engaging portion configured and positioned (a) to engage with the development coupling member and to receive a driving force for rotating said developing roller, and (b) to be movable in a direction crossing the axis of said developing roller relative to said developing roller;

(v) an urging portion configured and positioned to urge said engaging portion in a direction crossing the axis of said developing roller to enable engagement of said engaging portion with the development coupling member with insertion of said process cartridge into the main assembly of the apparatus along an axial direction of said developing roller; and (vi) an abutting portion configured and positioned to abut the abutting member so that a movement, relative to the abutting member, of said engaging portion which has not established an engagement with the development coupling member in the direction crossing the axis of said developing roller is prevented, when said process cartridge which has been inserted into the main assembly of the apparatus is moved in a direction crossing the axis of said developing roller, so as to enable engagement of said drum coupling portion with the drum coupling member.

2. A process cartridge according to claim 1, further comprising a regulating portion configured and positioned to regulate a position of said engaging portion which is urged by said urging portion.

3. A process cartridge according to claim 2, wherein said regulating portion regulates the position of said engaging portion so that a distance between an axis of said photosensitive drum and an axis of said engaging portion which is urged by said urging portion is shorter than a distance between the axis of said photosensitive drum and the axis of said developing roller when said process cartridge is inserted into the main assembly of the apparatus.

4. A process cartridge according to claim 3, wherein, when said developing roller develops the electrostatic image on said photosensitive drum, the axis of said engaging portion and the axis of said developing roller are substantially aligned with each other.

5. A process cartridge according to claim 2 or 3, further comprising a bearing portion configured and positioned to rotatably support said photosensitive drum, wherein said regulating portion is provided on said bearing portion.

6. A process cartridge according to claim 5, further comprising a positioning portion, provided on said bearing portion, configured and positioned to position said photosensitive drum by abutting to a main assembly positioning portion provided in the main assembly of the apparatus when said process cartridge, which has been inserted in the main assembly of the apparatus, is moved in the direction crossing the axis of said developing roller.

7. A process cartridge according to claim 2 or 3, further comprising a holding portion configured and positioned to rotatably hold said engaging portion, said holding portion being movable in a direction crossing the axis of said developing roller together with said engaging portion, wherein said urging portion urges said engaging portion through said holding portion, and wherein said abutting portion is provided on said holding portion.

8. A process cartridge according to claim 2 or 3, wherein said developing roller is movable between a contact position where said developing roller contacts said photosensitive drum, and a spaced position where said developing roller is spaced away from said photosensitive drum, and wherein said engaging portion is movable in the direction crossing the axis of said developing roller relative to said developing roller so as to permit said developing roller to move between the contact position and the spaced position.

9. A process cartridge according to claim 8, further comprising:

an urging member configured and positioned to urge said developing roller into contact with said photosensitive drum; and a locking portion configured and positioned to lock a position of said developing roller relative to said photosensitive drum against an urging force of said urging member to maintain said developing roller at a position where said developing roller is spaced away from said photosensitive drum, wherein said locking portion is unlocked with the insertion of said process cartridge into the main assembly of the apparatus.

10. A process cartridge according to claim 9, further comprising a force receiving portion configured and positioned to receive, from the main assembly of the apparatus, a force for maintaining said developing roller spaced away from said photosensitive drum with unlocking of said locking portion.

11. A process cartridge according to claim 10, wherein said developing roller is unified together with a developer container, configured and positioned to contain the developer, into a drum unit, wherein said photosensitive drum is unified, into a drum unit, together with (a) a charging member configured and positioned to electrically charge said photosensitive drum, and (b) a cleaning member configured and positioned to clean said photosensitive drum, and wherein said developing unit and said drum unit are connected so as to be rotatable relative to each other.

12. A process cartridge according to claim 2 or 3, wherein in the case that said engaging portion has established the engagement with the development coupling member with the insertion of said process cartridge into the main assembly of the apparatus, the movement of said engaging portion in the direction crossing the axis of said developing roller when said process cartridge is moved in the direction crossing the axis of said developing roller is regulated by the development coupling member without abutting of said abutting portion with the abutting member.

13. A process cartridge according to claim 2 or 3, wherein said urging portion is an elastic member.

14. A process cartridge according to claim 2 or 3, wherein said coupling member includes:

a driven portion fixed to the one axial end of said developing roller; and an intermediary portion configured and positioned to (a) engage with said driven portion and (b) be movable relative to said driven portion in a direction crossing the axis of said developing roller while maintaining engagement with said driven portion, wherein said engaging portion is configured and positioned to (a) engage with said intermediary portion, and (b) be movable relative to said intermediary portion in the direction which is different from the direction of movement of said intermediary portion while maintaining engagement of said engaging portion with said intermediary portion.

15. A process cartridge according to claim 1, wherein said photosensitive drum and said developing roller receive respective driving forces independently from each other.

16. An electrophotographic image forming apparatus including a main assembly of said apparatus and a process cartridge detachably mountable to said main assembly of said apparatus, comprising:

(1) said main assembly of said apparatus including:

(i) a drum coupling member configured and positioned to apply a driving force;

(ii) a development coupling member configured and positioned to apply a driving force; and (iii) an abutting member configured and positioned to abut to said process cartridge; and (2) said process cartridge including:

(i) a photosensitive drum;

(ii) a drum coupling portion provided adjacent to one axial end of said photosensitive drum, said drum coupling portion being configured and positioned to engage with said drum coupling member to receive a driving force for rotating said photosensitive drum;

(iii) a developing roller configured and positioned (a) to develop an electrostatic latent image formed on said photosensitive drum, and (b) to be rotatable about an axis thereof;

(iv) a development coupling portion provided adjacent to one axial end of said developing roller, said development coupling portion including:

an engaging portion configured and positioned (a) to engage with said development coupling member to receive a driving force for rotating said developing roller and (b) to be movable in a direction crossing the axis of said developing roller relative to said developing roller;

(v) an urging portion configured and positioned to urge said engaging portion in a direction crossing the axis of said developing roller to enable engagement of said engaging portion with said development coupling member with insertion of said process cartridge into said main assembly of said apparatus along an axial direction of said developing roller;

(vi) an abutting portion configured and positioned to abut said abutting member so that a movement, relative to said abutting member, of said engaging portion which has not established an engagement with said development coupling member in the direction crossing the axis of said developing roller is prevented, when said process cartridge, which has been inserted into said main assembly of said apparatus, is moved in a direction crossing the axis of said developing roller, so as to enable engagement of said drum coupling portion with said drum coupling member.

17. An electrophotographic image forming apparatus according to claim 16, wherein said process cartridge includes a regulating portion configured and positioned to regulate a position of said engaging portion which is urged by said urging portion.

18. An electrophotographic image forming apparatus according to claim 17, wherein said regulating portion regulates the position of said engaging portion so that a distance between an axis of said photosensitive drum and an axis of said engaging portion which is urged by said urging portion is shorter than a distance between the axis of said photosensitive drum and the axis of said developing roller when said process cartridge is inserted into said main assembly of said apparatus.

19. An electrophotographic image forming apparatus according to claim 18, wherein, when said developing roller develops the electrostatic image on said photosensitive drum, the axis of said engaging portion and the axis of said developing roller are substantially aligned with each other.

20. An electrophotographic image forming apparatus according to claim 17 or 18, wherein said process cartridge includes a bearing portion configured and positioned to rotatably support said photosensitive drum, and wherein said regulating portion is provided on said bearing portion.

21. An electrophotographic image forming apparatus according to claim 20, wherein said main assembly of said apparatus includes a main assembly positioning portion, and wherein said process cartridge includes a positioning portion, provided on said bearing portion, configured and positioned to position said photosensitive drum by abutting to said main assembly positioning portion when said process cartridge which has been inserted in said main assembly of said apparatus is moved in the direction crossing the axis of said developing roller.

22. An electrophotographic image forming apparatus according to claim 17 or 18, wherein said process cartridge includes a holding portion configured and positioned to rotatably hold said engaging portion, said holding portion being movable in a direction crossing the axis of said developing roller together with said engaging portion;

wherein said urging portion urges said engaging portion through said holding portion; and wherein said abutting portion is provided on said holding portion.

23. An electrophotographic image forming apparatus according to claim 17 or 18, wherein said developing roller is movable between a contact position where said developing roller contacts said photosensitive drum and a spaced position where said developing roller is spaced away from said photosensitive drum; and wherein said engaging portion is movable in the direction crossing the axis of said developing roller relative to said developing roller so as to permit said developing roller to move between the contact position and the spaced position.

24. An electrophotographic image forming apparatus according to claim 23, wherein said process cartridge includes:

an urging member configured and positioned to urge said developing roller into contact with said photosensitive drum; and a locking portion configured and positioned to lock a position of said developing roller relative to said photosensitive drum against an urging force of said urging member to maintain said developing roller at a position where said developing roller is spaced away from said photosensitive drum, wherein said locking portion is unlocked with the insertion of said process cartridge into said main assembly of said apparatus.

25. An electrophotographic image forming apparatus according to claim 24, wherein said process cartridge includes a force receiving portion configured and positioned to receive, from said main assembly of said apparatus, a force for maintaining said developing roller spaced away from said photosensitive drum with unlocking of said locking portion.

26. An electrophotographic image forming apparatus according to claim 25, wherein said developing roller is unified, into a developing unit, together with a developer container configured and positioned to contain the developer, wherein said photosensitive drum is unified, into a drum unit, together with (a) a charging member configured and positioned to electrically charge said photosensitive drum and (b) a cleaning member configured and positioned to clean said photosensitive drum, and wherein said developing unit and said drum unit are connected so as to be rotatable relative to each other.

27. An electrophotographic image forming apparatus according to claim 17 or 18, wherein, in the case that said engaging portion has established engagement with said development coupling member with the insertion of said process cartridge into said main assembly of said apparatus, the movement of said engaging portion in the direction crossing the axis of said developing roller when said process cartridge is moved in the direction crossing the axis of said developing roller is regulated by said development coupling member without abutting of said abutting portion with said abutting member.

28. An electrophotographic image forming apparatus according to claim 17 or 18, wherein said urging portion is an elastic member.

29. An electrophotographic image forming apparatus according to claim 17 or 18, wherein said coupling member includes:

a driven portion fixed to the one axial end of said developing roller; and an intermediary portion configured and positioned (a) to engage with said driven portion and (b) to be movable relative to said driven portion in a direction crossing the axis of said developing roller while maintaining engagement with said driven portion, wherein said engaging portion configured and positioned (a) to engage with said intermediary portion and (b) to be movable relative to said intermediary portion in the direction which is different from the direction of movement of said intermediary portion while maintaining engagement of said engaging portion with said intermediary portion.

30. An electrophotographic image forming apparatus according to claim 29, wherein said photosensitive drum and said developing roller receive respective driving forces independently from each other.

31. A development cartridge detachably mountable to a main assembly of an electrophotographic image forming apparatus, including a development coupling member and an abutting member, said development cartridge comprising:

(i) a developing roller rotatable about an axis thereof;

(ii) a development coupling portion provided adjacent to one axial end of said developing roller, said development coupling portion including:

an engaging portion configured and positioned (a) to engage with the development coupling member to receive a driving force for rotating said developing roller, and (b) to be movable in a direction crossing the axis of said developing roller relative to said developing roller;

(iii) an urging portion configured and positioned to urge said engaging portion in a direction crossing the axis of said developing roller to enable engagement of said engaging portion with the development coupling member with insertion of said development cartridge into the main assembly of the apparatus along an axial direction of said developing roller; and (iv) an abutting portion configured and positioned to abut to the abutting member so that a movement, relative to the abutting member, of said engaging portion which has not established an engagement with the development coupling member in the direction crossing the axis of said developing roller is regulated, when said development cartridge, which has been inserted into the main assembly of the apparatus, is moved in a direction crossing the axis of said developing roller.

* * * * *